US007614356B2

(12) United States Patent
Knisely et al.

(10) Patent No.: US 7,614,356 B2
(45) Date of Patent: Nov. 10, 2009

(54) FOLDABLE MAST ASSEMBLY FOR A SAILING VESSEL

(75) Inventors: Charles W. Knisely, Lewisburg, PA (US); Henry M. Baylor, Lewisburg, PA (US); Matthew A. O'Rourke, Bridgewater, NJ (US); Thomas C. Walker, Lewisburg, PA (US); Jacob C. D. Clark, Downingtown, PA (US)

(73) Assignee: Susquehanna Yacht Manufacturing, Inc., Lewisburg, PA (US)

( * ) Notice: Subject to any disclaimer, the term of this patent is extended or adjusted under 35 U.S.C. 154(b) by 0 days.

(21) Appl. No.: 11/969,137

(22) Filed: Jan. 3, 2008

(65) Prior Publication Data

US 2008/0156242 A1 Jul. 3, 2008

Related U.S. Application Data

(60) Provisional application No. 60/883,321, filed on Jan. 3, 2007.

(51) Int. Cl.
*B63B 15/00* (2006.01)

(52) U.S. Cl. ..... 114/90; 114/39.32; 114/91

(58) Field of Classification Search ..... 114/39.11, 114/39.21, 39.32, 90, 91, 93, 97, 112
See application file for complete search history.

(56) References Cited

U.S. PATENT DOCUMENTS

| | | | | |
|---|---|---|---|---|
| 0,145,648 | A | 12/1873 | Hammond | |
| 0,282,592 | A | 8/1883 | Walthour | |
| 3,577,576 | A | 5/1971 | Lobb et al. | |
| 3,768,426 | A | 10/1973 | Kratz | |
| 3,827,386 | A | 8/1974 | Faden | |
| 3,838,655 | A | 10/1974 | Kratz | |
| 3,839,979 | A | 10/1974 | Wassell | |
| 3,898,948 | A | 8/1975 | Huff | |
| 3,996,868 | A | 12/1976 | Schagen | |
| 4,016,823 | A | 4/1977 | Davis | |
| 4,112,861 | A * | 9/1978 | Lewis | 114/91 |
| 4,259,917 | A | 4/1981 | Frank | |
| 4,530,299 | A | 7/1985 | Ross | |
| 4,655,154 | A * | 4/1987 | Leonard | 114/91 |
| 4,738,212 | A | 4/1988 | Schweitzer | |
| 4,934,295 | A | 6/1990 | Atkinson et al. | |
| 4,940,008 | A | 7/1990 | Hoyt | |
| 5,044,410 | A | 9/1991 | Mix | |
| 6,000,354 | A | 12/1999 | Vanlerberghe | |
| 6,526,901 | B2 | 3/2003 | Iacoboni | |
| 6,990,916 | B1 | 1/2006 | Atwood | |

(Continued)

FOREIGN PATENT DOCUMENTS

| | | |
|---|---|---|
| EP | 274282 | 7/1988 |

*Primary Examiner*—Lars A Olson
(74) *Attorney, Agent, or Firm*—Alleman Hall McCoy Russell & Tuttle LLP

(57) ABSTRACT

As one non-limiting example, a foldable mast assembly for a sailing vessel is provided. The foldable mast assembly includes a lower mast section; an intermediate mast section having a lower end foldably coupled to an upper end of the lower mast section; an upper mast section having a lower end foldably coupled to an upper end of the intermediate mast section; and a boom coupled to the lower mast section. A locking device internal the mast assembly is also provided to inhibit folding of the mast assembly.

14 Claims, 22 Drawing Sheets

U.S. PATENT DOCUMENTS 7,137,346 B1 11/2006 Francke
2002/0139284 A1 10/2002 Iacoboni
2005/0252432 A1 11/2005 Pamula

* cited by examiner

FOLDABLE MAST ASSEMBLY FOR A SAILING VESSEL

The present application claims priority to U.S. Provisional Patent Application No. 60/883,321, filed Jan. 3, 2007, and entitled "Reconfigurable Watercraft", the entire contents of which are incorporated herein by reference.

BACKGROUND AND SUMMARY

Sailing vessels can utilize a mast for supporting one or more sails. In some examples, the size and/or configuration of the mast can impose limitations on the use or transportability of the watercraft. As one example, a sailing vessel may be transported by trailer between two bodies of water or between a body of water and a storage location. During transportation, the mast may be removed or unstepped from the deck or hull where it may be secured along the length of the hull to reduce the height of the sailing vessel. However, where the mast is of greater length than the hull, the mast may extend considerably beyond the hull profile, thereby making transportation of the sailing vessel more difficult. Furthermore, during operation of the sailing vessel, the height of the mast may also limit the ability of the sailing vessel to pass under low lying structures, such as bridges or wires that are located at a relatively low height above the water.

The process of stepping and unstepping the mast can also be difficult, work intensive, and time consuming. For example, some masts may require the assistance of multiple people to complete the stepping process due to the size and/or weight of the mast. Further still, mast stays or guy wires may be adjusted, reattached, or disassembled as a consequence of the stepping or unstepping process, thereby further complicating the stepping process.

U.S. Pat. No. 4,112,861 (Lewis) provides one approach for addressing some of the above issues. Lewis describes a mast stepping and unstepping structure that enables the mast to be stepped or unstepped without requiring that the stays and shrouds be tuned.

However, the inventors have recognized some issues with the above approach. As one example, the inventors have recognized that the approach of Lewis does not address how a boom structure may be treated during the mast stepping and unstepping process. Furthermore, the inventors have recognized that the approach of Lewis hinges two mast sections on the sail, which can reduce the continuity of the track across a joint or interface between two mast sections or obstruct the track. Further still, the approach by Lewis still requires stepping and unstepping of the mast for purposes of transportation and storage.

To address at least some of the above issues, the inventors have provided, as one example, a foldable mast assembly for a sailing vessel, comprising: a lower mast section; an intermediate mast section having a lower end foldably coupled to an upper end of the lower mast section; an upper mast section having a lower end foldably coupled to an upper end of the intermediate mast section; and a boom coupled to the lower mast section. By coupling the boom to the lower section of the mast assembly, the inventors have recognized that the intermediate and upper mast sections may be more easily folded, without necessarily requiring reconfiguration of the boom.

As another example, the inventors have provided a foldable mast assembly for a sailing vessel, comprising: an upper mast section including a first track segment at a stern side of the upper mast section, the first track segment being adapted to guide a luff edge of a sail between a raised configuration and a lowered configuration of the sail; an intermediate mast section including a second track segment at a stern side of the intermediate mast section, the second track segment being adapted to guide the luff edge of the sail between the raised configuration and lowered configuration; a first hinge assembly foldably coupling a lower end of the upper mast section at a bow side of the upper mast section to an upper end of the intermediate mast section at a bow side of the intermediate mast section. Thus, the inventors have recognized that in some examples, placing the hinge on an opposite of the mast assembly from the track can reduce discontinuities between two track sections that are located at different foldable mast sections.

As yet another example, the inventors have provided a foldable mast assembly for a sailing vessel providing at least an erected position and a folded position, comprising: a lower mast section; a stepping support fixedly coupling the lower mast section to a sailing vessel; an intermediate mast section having a lower end rotationally coupled to an upper end the lower mast section by a first hinge assembly that permits an upper end of the intermediate mast section to rotate from the erected position toward the stern of the sailing vessel and into the folded position without unstepping the lower mast section from the stepping support; and an upper mast section having a lower end rotationally coupled to an upper end of the intermediate mast section by a second hinge assembly that permits an upper end of the upper mast section to rotate from the erected position toward the bow of the sailing vessel and into the folded position without unstepping the lower mast section from the stepping support. In this way, the mast assembly can be folded or erected without requiring the mast assembly to be unstepped from the stepping support.

DETAILED DESCRIPTION

Figure 1:
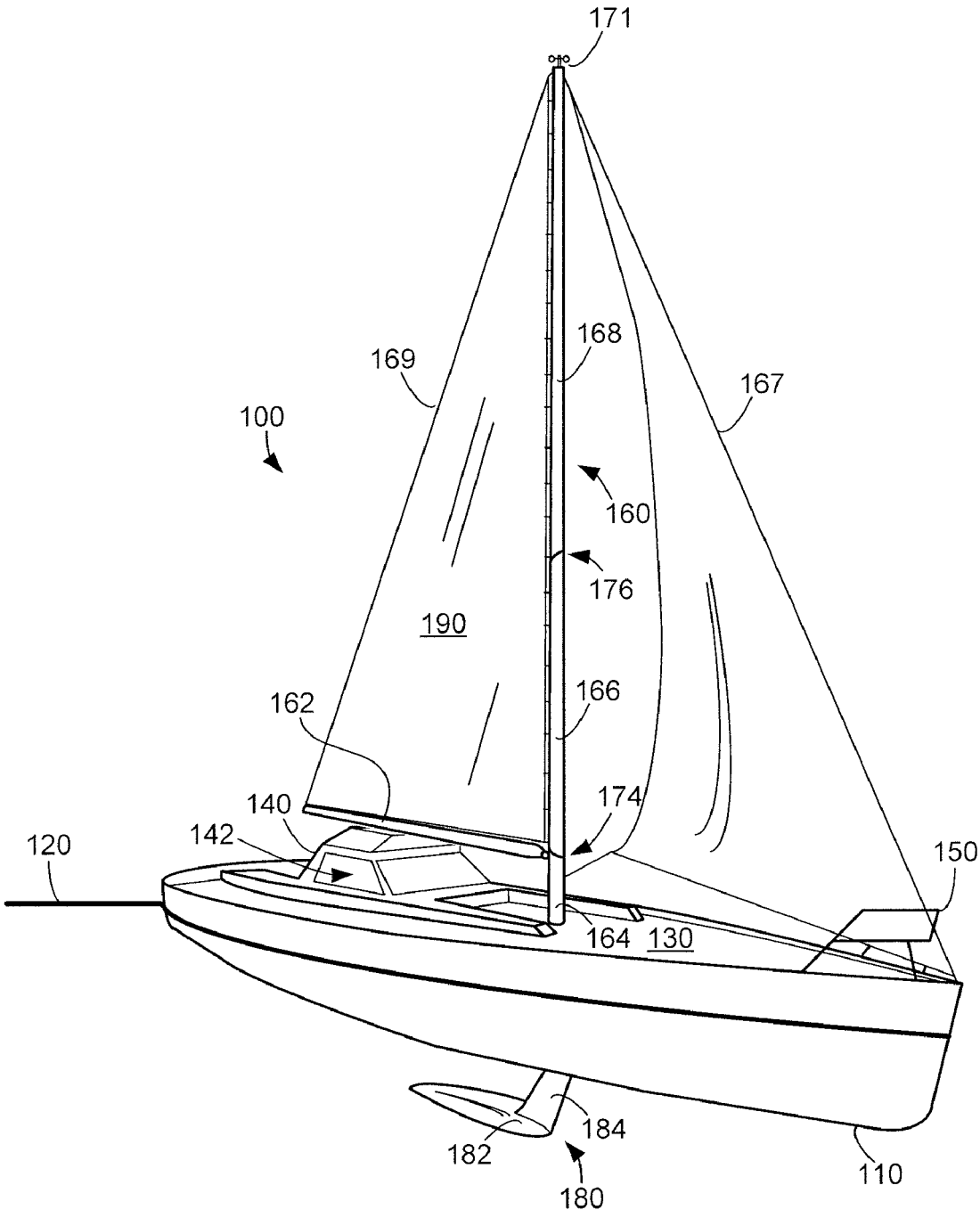
FIG. 1 illustrates an example watercraft having a sailing boat configuration.

Referring to FIG. 1, an example watercraft having a sailboat configuration is provided. In particular, FIG. 1 illustrates a watercraft 100 including a hull 110 which is at least partially submerged beneath water line 120. As illustrated in FIG. 1, hull 110 may be configured as a displacement hull, at least during some conditions. Hull 110 may include a deck 130, which may at least partially support a bridge 140, a cockpit area 142, a pulpit 150, and a mast assembly 160.

Mast assembly 160 may include a boom 162 and/or other suitable structure for supporting one of more sails. Mast assembly 160 including boom 162 is shown in FIG. 1 supporting a sail 190. Boom 162 may include a furling system, whereby sail 190 can be at least partially stored within the boom structure, for example, by rolling within an internal region of the boom. Boom 162 may be coupled to mast assembly 160 at lower mast section 164.

Mast assembly 160 may also include one or more sensors indicated generally at 171 for measuring ambient conditions. For example, the mast assembly may include a wind anemometer located near the top of the mast assembly for detecting wind speed and/or direction, among other suitable sensors. Output signals may be received from the sensors by way of wireless communication or alternatively by way of wires or cables. In some embodiments, watercraft 100 may include a control system that can receive signals (e.g. either wireless or by wired communication) from sensor 171 among other on-board sensors. Where wireless communication is utilized, the sensors may be powered by solar energy via a photovoltaic system. Where wired communication is utilized, any suitable communication and/or power cables or wires may be located within the mast assembly. In this manner, information relating to ambient conditions may be transmitted from the sensors to where the information can be received by a suitable gauge, control system, recording device, etc. located, for example, at the cockpit 142. Further, in some examples, mast assembly 160 may include a light emitting device such as a bulb or LED in the location generally indicated at 171. The light emitting device can receive electrical energy via any suitable cables or wires passing through the mast assembly to a power source stored on-board the watercraft.

Mast assembly 160 may include two or more mast sections that are moveably coupled to each other to enable reconfiguration of the mast between at least two different configurations. As one example, mast assembly 160 may be folded between an erected configuration (e.g. during a sailing operation) as illustrated in FIG. 1 and a folded configuration (e.g. during a powered operation or during transportation) as illustrated in FIG. 2.

In the example provided herein, mast assembly 160 includes three mast sections 164, 166, and 168; however any suitable number of mast sections may be utilized. However, it should be appreciated that the use of at least three mast sections can achieve some advantages over a mast assembly that includes only two mast sections. For example, three mast sections can be used to enable the mast assembly to be folded into a smaller region than a mast assembly having only two mast sections. Additionally, a mast assembly having at least three mast sections can enable the mast assembly to be folded without necessarily requiring that the mast stays or guy wires be adjusted or removed.

A base section or lower section 164 can be fixed to the hull and/or deck of the watercraft as will be described in greater detail with reference to FIGS. 3A and 11. For example, base section 164 may be deck stepped (e.g. anchored to the deck surface) or may be keel stepped (e.g. passing through the deck where it is anchored to the keel and/or the hull). However, any suitable stepping system may be used to support mast assembly 160.

Figure 2:
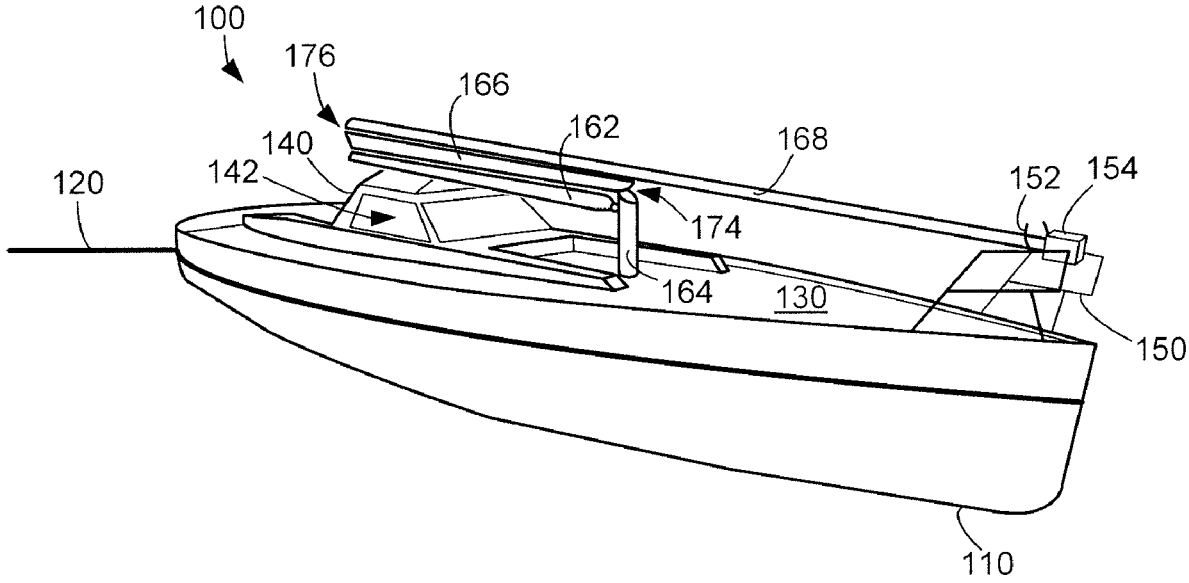
FIG. 2 illustrates the watercraft of FIG. 1 in a power boat or transportable configuration.

Intermediate section 166 may be foldably coupled to base section 164 as indicated generally at 174 so that the intermediate section may be folded or rotated relative to the base, for example, between the configurations of FIGS. 1 and 2 or other suitable configuration. Similarly, upper mast section 168 may be foldably coupled to intermediate section 166, as indicated generally at 176, so that the upper section of the mast assembly may be folded or rotated relative to intermediate section 168. A further description of the folding of mast assembly 160 is provided with reference to FIGS. 3-13.

As illustrated in FIG. 2, the mast assembly may be secured to the bridge and/or pulpit during the folded configuration to enable transportation of the watercraft, such as by trailer, or to enable operation of the watercraft in areas where bridges or other low level obstructions may interfere with the mast assembly in the erected configuration of FIG. 1. Thus, mast assembly 160 may be reconfigured to reduce the overall height of the watercraft. In some embodiments, pulpit 150 may include a cradle 152 for receiving the mast assembly. Cradle 152 can be U-shaped, V-shaped, or other suitable shape for receiving and securing the mast assembly in the folded configuration. Similarly, the bridge may include a cradle for receiving and securing the mast assembly as illustrated in FIG. 3C. Further, in some examples, as described in greater detail with reference to FIGS. 3C and 4, pulpit 150 may include a guard assembly 154 for protecting sensors 171 while in the folded configuration.

In some examples, mast assembly 160 may be reconfigured between the configurations of FIG. 1 and FIG. 2 without requiring disassembly or adjustment of at least some of the mast stays, for example, indicated generally at 167 and 169. As one approach, the relative lengths of the various mast sections and/or location of the movable couplings between the mast sections may be selected so that the locus of attachment points for the mast stays is within a range that is equal to or less than the erected length of the mast stays during the transition between the folded and erected configurations. In this way, the mast may be erected or folded without requiring adjustment or reconfiguration of the mast stays. However, it should be appreciated that in other examples, the mast assembly can be reconfigured between the erected and folded configurations by adjusting or reconfiguring some of the mast stays.

Hull 110 may include a keel 180 including an arm 184 and a bulb 182. In alternative embodiments, keel 180 may not include a bulb, for example, as depicted by some of the examples in FIG. 19. In some embodiments, keel 180 may be translated relative to the hull to vary the depth of the keel. As one example application, the keel may be retracted to enable operation of the watercraft in more shallow water depths, where a fully deployed keel may otherwise contact the bottom surface. For example, FIG. 2 illustrates how the keel may be retracted, such as during shallow water operation or during operation as a powerboat, while FIG. 1 illustrates how the keel may be deployed, such as during sailing operation, for example, where greater lateral stability of the watercraft may be desired. The deployment of keel 180 will be described in greater detail with reference to FIGS. 14-16. Note that in some examples, the keel may be fixed to the hull or the hull may not include a keel.

In some embodiments, keel 180 may include a bulb 182 for storing ballast. The amount of ballast may be adjusted, for example, by increasing or decreasing the amount of water retained by the bulb and/or arm of the keel. In this manner, the center of mass of the watercraft may be lowered or raised by respectively increasing or decreasing the ballast. Further, the center of mass of the watercraft may be adjusted by raising or lowering the keel in addition to or independent of the particular ballast provided by bulb 182. The adjustment of the keel depth and/or amount of ballast may be accompanied by an adjustment of ballast located at various locations of the watercraft in order to maintain a suitable trim or orientation of the watercraft. Further still, as will be described herein, bulb 182 may include a bottom surface that at least partially defines the bottom surface of the hull where the keel is fully retracted. In this manner, the shape and/or configuration of the hull may be adjusted. For example, the hull may be configured as a planing hull for powerboat operation when the keel is retracted.

These and other features described above with reference to FIGS. 1 and 2 will be set forth in greater detail below.

Referring now to FIGS. 3-13, mast assembly 160 is described in greater detail. In particular, FIGS. 3A-3C and FIG. 4 illustrate how mast assembly 160 may be reconfigured between the erected configuration and the folded configuration without requiring unstepping of the mast assembly. FIG. 3A illustrates mast assembly in the erected configuration, such as may be utilized during a sailing operation to support one or more sails, for example, as illustrated in FIG. 1. Base section 164 of the mast assembly 160 is shown fixed to deck 130. Intermediate section 166 is shown moveably coupled to base section 164 by a hinge assembly 310. Upper section 168 is shown moveably coupled to intermediate section 166 by hinge assembly 320. Note that in this particular example, hinge assemblies 310 and 320 are located on opposite sides of mast assembly 160 to enable the mast to collapse upon itself as shown in FIGS. 3B and 3C. Further, in this particular example, the direction of travel of the watercraft (e.g. the bow of the boat) is indicated by vector 330; however, it should be appreciated that in other examples, the mast assembly may be facing in the opposite direction (e.g. turned 180 degrees about the vertical axis of the mast assembly). Rear mast stays are indicated generally at 169 and front mast stays are indicated generally at 167. Further sensors 171 are shown at the top of mast assembly 160.

Figure 3A:
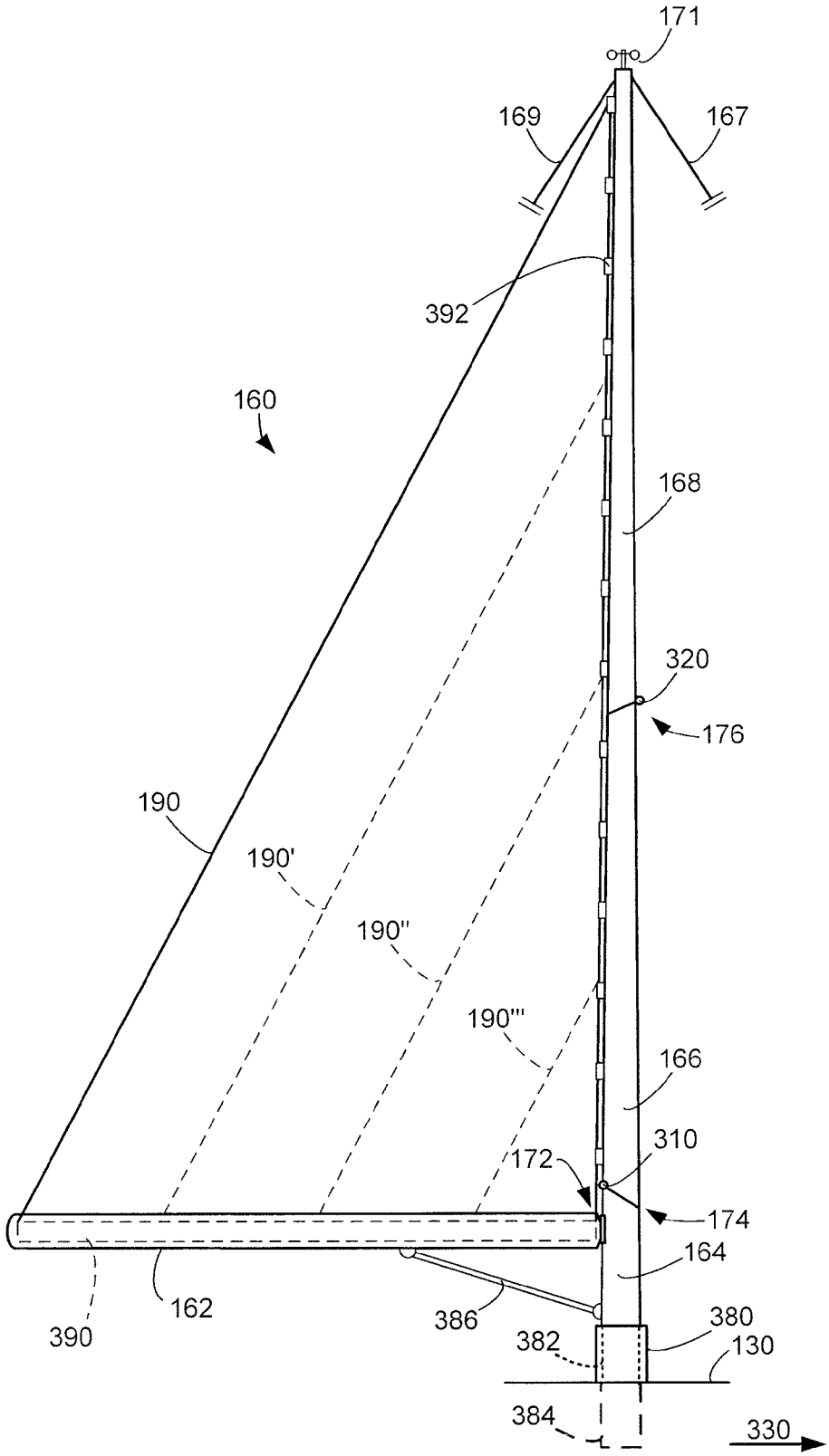
FIGS. 3A, 3B, 3C, and 4 illustrate an example mast assembly that is reconfigurable between folded and erected configurations.

As illustrated in FIG. 3A, interface 174 is defined by the upper end of base section 164 and the lower end of intermediate section 166. In this particular example, interface 174 is angled relative to a plane that is orthogonal to the longitudinal axis of the mast assembly. The angled interface between mast sections can be used to facilitate alignment and/or joining of the mast sections during reconfiguration of the mast assembly, as will be described in greater detail. For example, an interface between two mast sections may be angled approximately 30 degrees relative to the orthogonal plane; however, it should be appreciated that any suitable angle may be used. For example, interface 174 can be orthogonal to the longitudinal axis of the mast as shown in FIG. 9A. Interface 176 is defined by the upper end of intermediate section 166 and the lower end of upper section 168. Interface 176 can be configured with the same or different angle as interface 174.

Figure 5B:
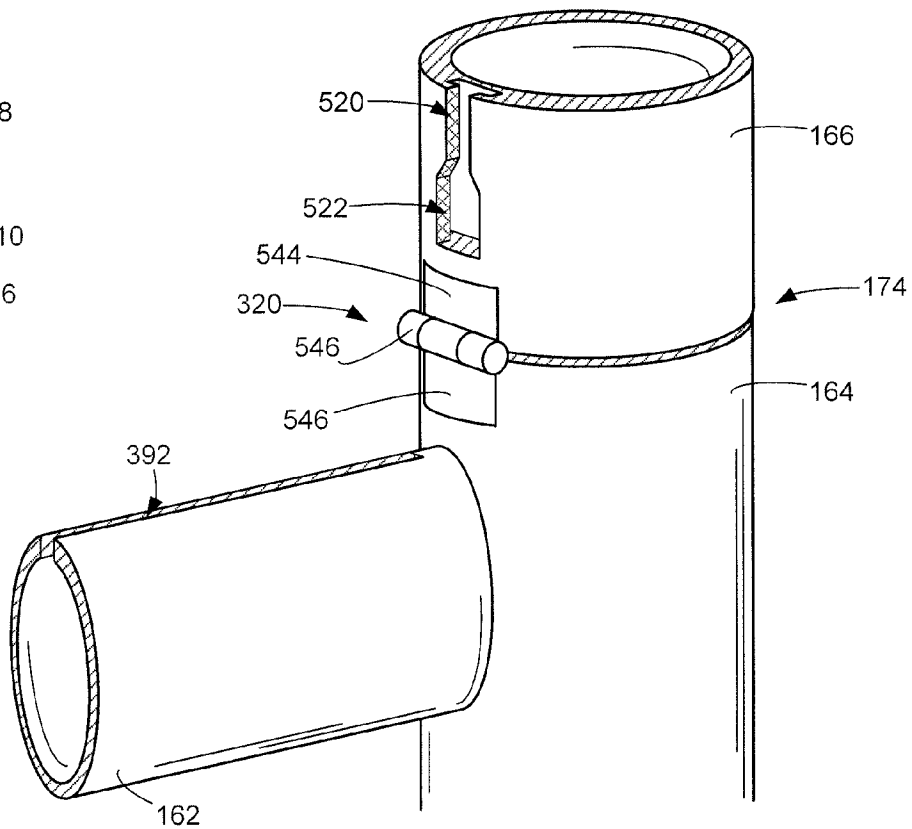
FIG. 5B illustrates a detailed view of an example interface between lower and intermediate mast sections of the mast assembly.
Figures 6A, 6B, 6C:
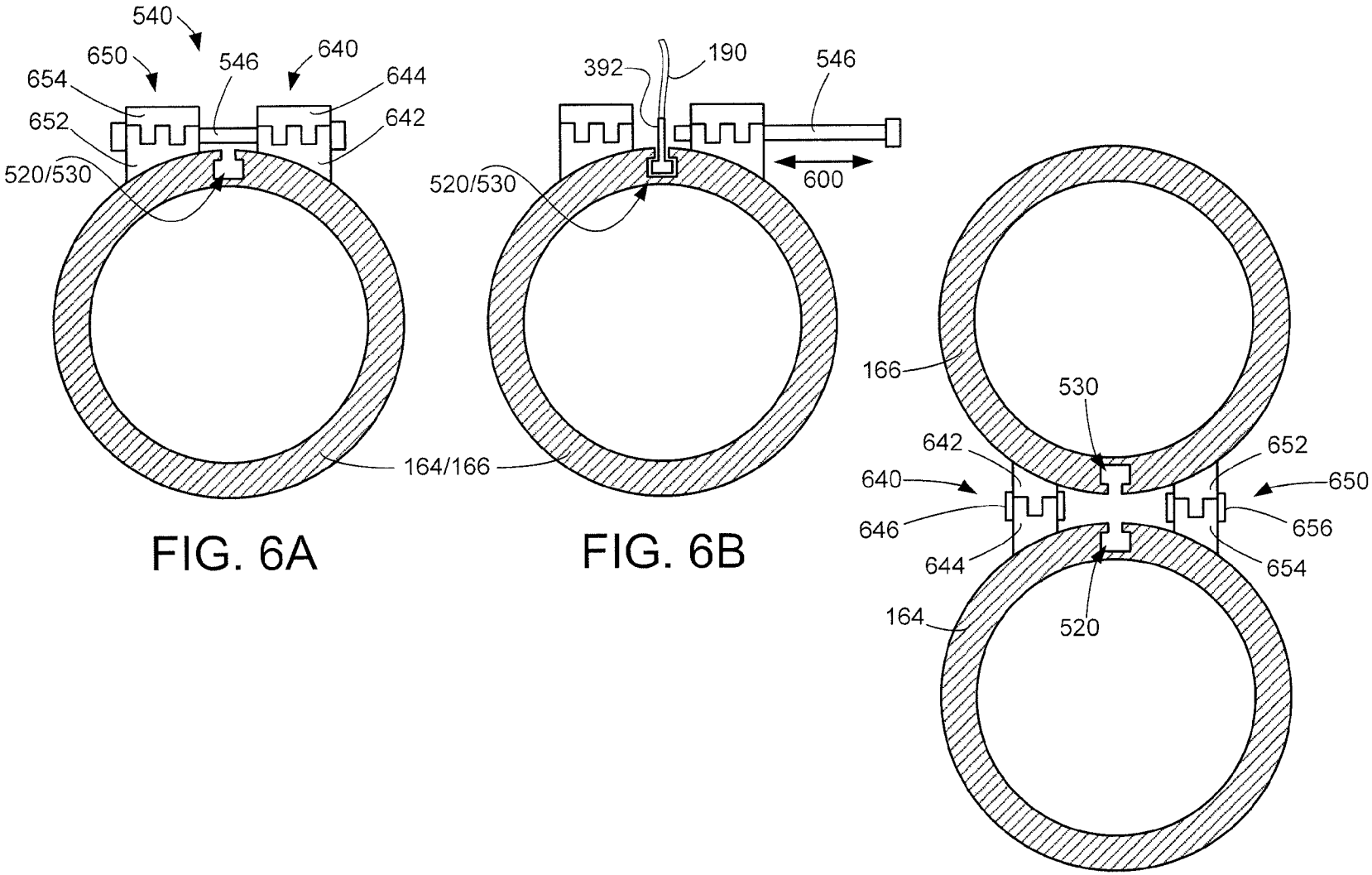
FIGS. 6A, 6B, and 6C illustrate examples of alternative hinge assemblies that may be used at an interface between two mast sections of the mast assembly.

As illustrated in at least FIG. 3A, hinge assemblies 310 and 320 can be located on opposite sides of the mast assembly to enable the mast to fold within a smaller region. For example, the upper hinge assembly 320 can be located on the bow side of the mast assembly opposite main sail 190 so that a track located along the stern side of the mast assembly for guiding the sail can be substantially continuous and uninterrupted by the upper hinge assembly. Lower hinge assembly 310 can be located on the stern side of the mast assembly below the lower end of the track as shown in FIG. 5B. However, in other examples, as shown in FIG. 6C, the lower hinge assembly can be configured to enable the track to pass through the hinge assembly without being interrupted, thereby enabling the track to extend to the lower end of the intermediate mast section or onto the lower mast section.

Further, boom 162 is shown pivotally coupled to intermediate section 166 at joint 172. In some examples, boom 162 may be configured as a furling boom that includes a furler 390 for furling and unfurling sail 190. For example, as shown at the various locations of sail 190 depicted as 190', 190", and 190'", the sail can be moved upward or downward along mast assembly 160. As one example, sail 190 can include a plurality of track slides 392 for guiding and retaining the luff edge of the main sail at the track arranged along a stern side of mast assembly 160.

FIG. 3A also illustrates how mast assembly 160 may be deck stepped as indicated at 382 or keel stepped as indicated at 384, whereby the mast assembly passes through the surface of deck 310. In some examples, a mast stepping support 380 may be used to secure the base section of the mast assembly to the deck, particularly where mast assembly 160 is deck stepped. A detailed view of an example mast stepping support is shown in FIG. 11. Furthermore, in some examples, boom 162 may include a vang 386, which can provide support to the boom. In this particular example, vang 386 is arranged between base section 164 and boom 162. However, in other examples, vang 386 may be arranged between mast stepping support 380 and boom 162.

Figure 3B:
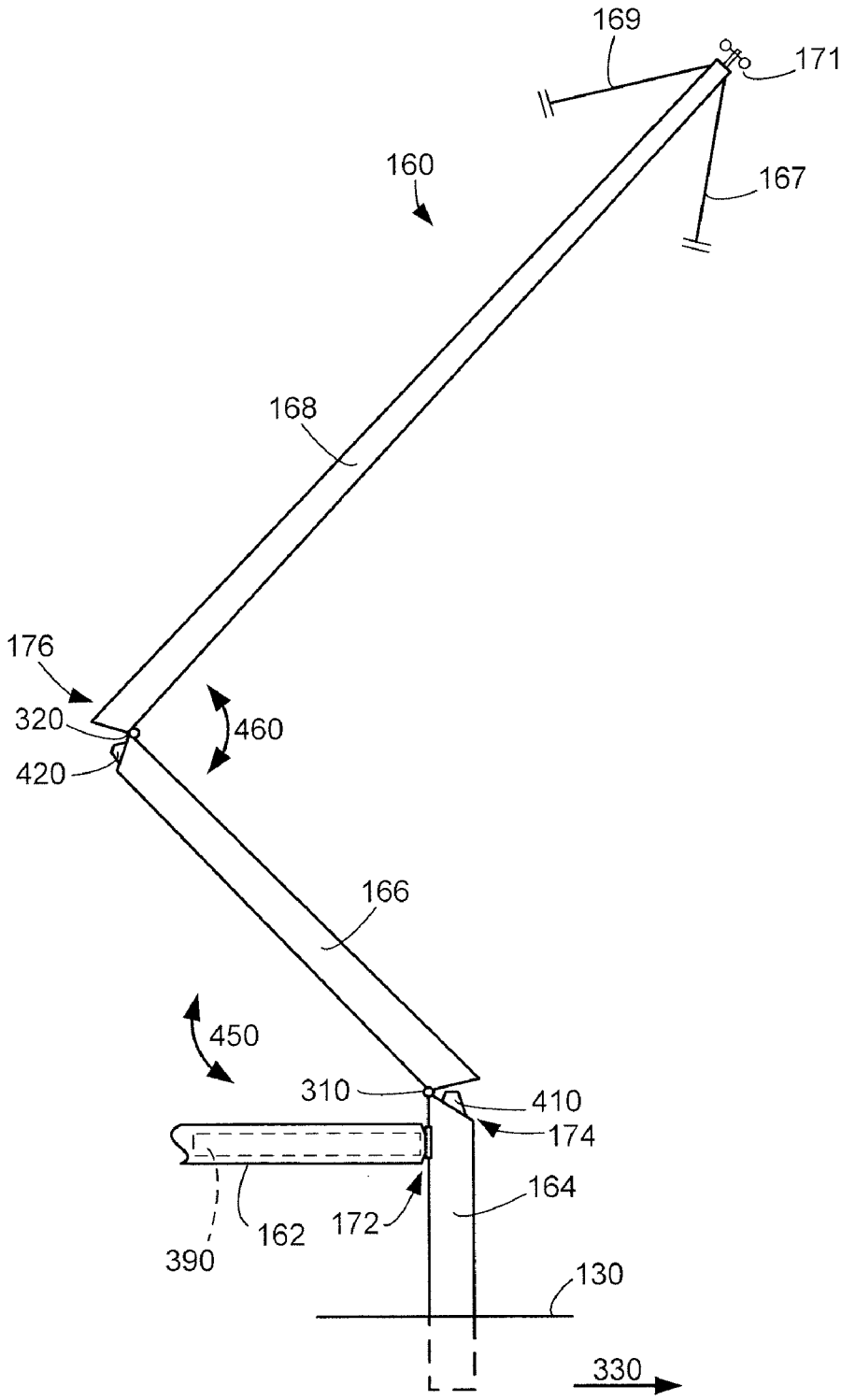
Figure 3C:
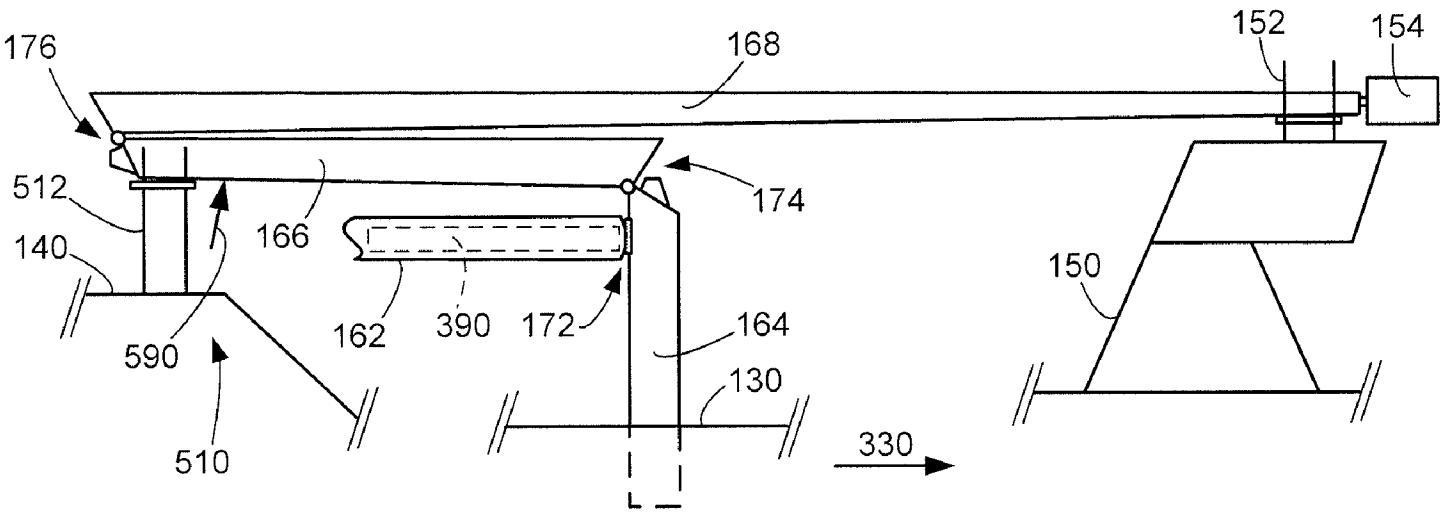
Figure 4:
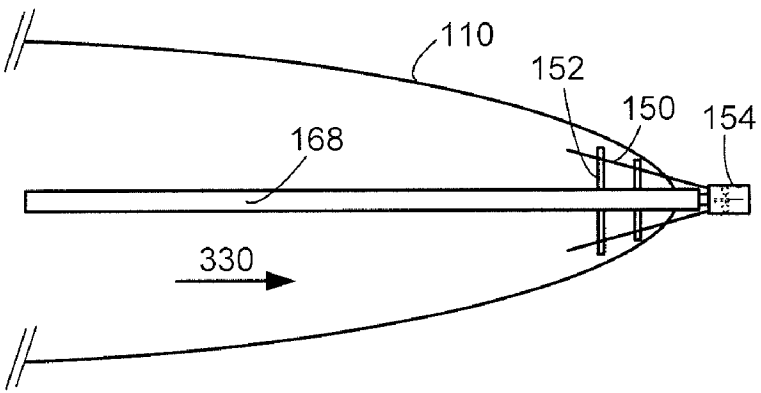

FIG. 3B illustrates mast assembly 160 in a transitional state between the erected configuration of FIG. 3A and the folded configuration of FIGS. 3C and 4. During reconfiguration of the mast assembly, intermediate section 166 can be rotated relative to base section 164 about hinge assembly 310 as indicated by vector 450. Where intermediate mast section is rotated relative to the base, a moveable internal insert may be at least partially exposed as indicated at 410. As will be described in greater detail with reference to FIGS. 7A, 7B, and 7C, a moveable internal insert can be drawn away (e.g. downward) from interface 174 to enable rotation of the intermediate section relative to the base section of the mast. Further, in some examples, as indicated at 410 this moveable insert can protrude above the upper edge of base section 164 to facilitate alignment of the two mast sections where they are erected. Similarly, upper section 168 can be rotated relative to intermediate section 166 about hinge assembly 320 as indicated by vector 460, thereby exposing a second moveable insert indicated at 420. Note that the position of the mast sections may be controlled during the transitional state between the erected and folded configuration by mast stays 169 and/or 167, or other suitable stays or cables as will be described with reference to FIGS. 12 and 13.

FIGS. 3C and 4 illustrate the mast assembly in the folded configuration as a side view and a top view, respectively. As one non-limiting example, while arranged in the folded configuration, intermediate section may be rotated toward the rear of the watercraft, where it may be secured to the bridge as indicated generally at 510. As one example, a cradle indicated at 512 can be used to support and secure the mast assembly to the bridge or other suitable structure of the watercraft. Alternatively or additionally, upper section 168 may secured to the bridge via the cradle. Furthermore, the opposite or upper end of upper section 168 may be secured to the pulpit 150 or other suitable structure of the watercraft by a cradle 152.

In some examples, the various sensors indicated at 171 can be stored within a guard assembly 154 to protect the sensors from damage during transportation or where they are not in use during the folded configuration of the mast assembly. As one non-limiting example, the guard assembly can include a box or cage structure having a lid or cover that may be opened to receive the sensors and/or top of the mast assembly and be closed by the user to protect the sensors contained therein. Boom 162 is shown rotated to a position that is substantially parallel to and beneath intermediate section 166, and may be at least partially supported by cradle 512, at least in some examples.

The relative length and/or quantity of mast sections can be selected to achieve one or more of the features and advantages described herein. For example, the mast assembly configuration can be selected to enable reconfiguration of the mast assembly between the erected and folded configurations without necessarily requiring disassembly or adjustment of the mast stays, enabling the mast assembly to be folded without requiring unstepping or removal of the mast assembly from the deck, and enabling the mast assembly to be folded substantially along the length of the hull so that the total size (e.g. length, width, and/or height) of the watercraft may be reduced, for example, during transportation via a trailer. Further, the location of the hinges and/or length of the mast sections can be selected to enable a substantially continuous track for securing the main sail that is unobstructed along a substantial length of the mast assembly as will shown in greater detail with reference to FIGS. 5A and 5B.

As illustrated in FIGS. 3A-3C, intermediate section 166 can be substantially shorter than upper section 168. As one non-limiting example, upper section 168 may be approximately twice the length of intermediate section 166. It should be appreciated that any suitable length and/or quantify of mast sections may be utilized to achieve some or all of the advantages described herein. For example, in some embodiments, a mast assembly may include only two mast sections or alternatively may include four or more mast sections having similar or different lengths.

Figure 5A:
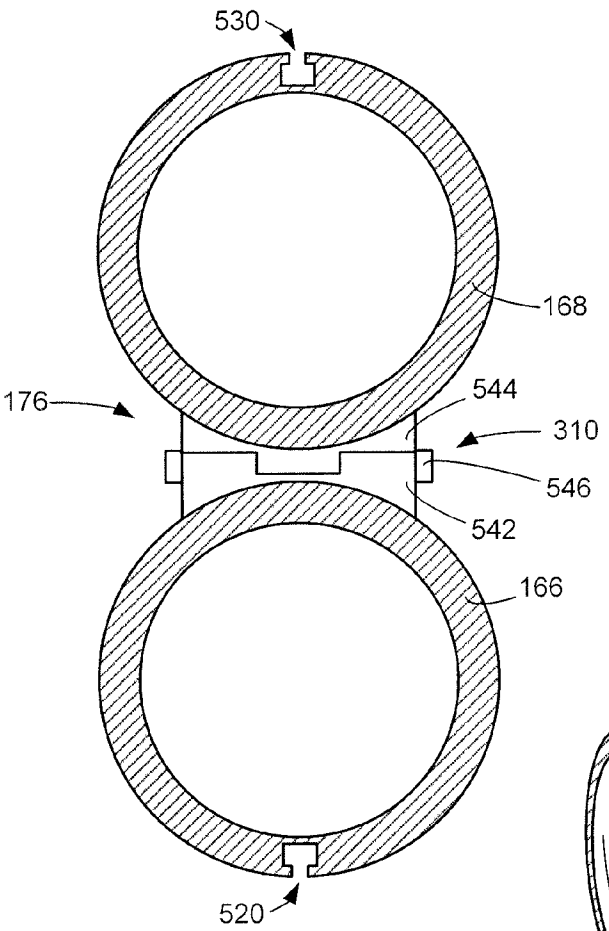
FIG. 5A illustrates a detailed view example interface between intermediate and upper mast sections of the mast assembly.

FIG. 5A shows an example of interface 176 between upper section 168 and intermediate section 166. In this particular example, section 168 is rotated relative to section 166, for example, as shown in FIG. 3C. Hinge assembly 320 is shown including a first hinge half 542 fixedly coupled to mast section 166 and a second hinge half 544 fixedly coupled to mast section 168. Hinge halves 542 and 544 may be rotationally joined via one or more pins indicated at 546. A track for receiving the track slides of the sail is shown in each of sections 168 and 166, on an opposite side of the mast assembly from hinge assembly 310. In this example, the track associated with intermediate section 166 is depicted schematically at 520 and the track associated with upper section 168 is shown schematically at 530. In this particular example, the mast assembly is configured in the erect configuration. Hinge assembly 310 is shown including a first hinge half 542 fixedly coupled to mast section 164 and a second hinge half 544 fixedly coupled to mast section 166. Hinge halves 542 and 544 may be rotationally joined via one or more pins indicated at 546.

In this particular example, track 520 of mast section 166 is shown including a lower end 522 that is adapted to receive the track slides as the sail is unfurled from boom 162 via opening 392. In this example, track 520 begins at a point above hinge assembly 310. However, in other examples, a hinge having a removable pin or a split hinge may be used to enable the track to extend onto base section 164 so that it is closer to opening 392 of boom 162. Examples of other hinge assemblies for enabling the track to extend onto base section 164 are shown in greater detail in FIGS. 6A-6C.

Hinge assemblies 310 or 320 can be secured to the mast section utilizing any suitable approach including welding, gluing, screwing, bolting, or press-fitting, etc. However, in some examples, the hinge halves may be integrally formed in the material of each of the mast sections. As one example, the hinge assemblies can be configured to enable two mast sections to rotate between a configuration where the longitudinal axis of the mast sections are aligned (e.g. during the erected configuration) and a configuration where one of the mast sections is rotated up to 180 degrees relative to another (e.g. during the folded configuration). In some examples, the point of rotation of hinge assemblies 310 and 320 may be located at a distance away from the surface of the mast assembly or may alternatively reside along or within the surface of the mast assembly or may reside internal the mast assembly to reduce discontinuities in the mast surface.

FIGS. 6A and 6B show an alternative hinge assembly 540 that may be used for hinge assembly 310 and/or 320 as previously described. In this example, hinge assembly 540 may be split into two separate hinges 640 and 650. Hinge 640 can include a first hinge half 642 coupled to a first mast section and a second hinge half 644 coupled to a second mast section. Hinge 650 can also include a first hinge half 652 also coupled to the first mast section and a second hinge half 654 also coupled to the second mast section. A removable pin 546 can be provided to rotationally join hinge halves 654 and 644 to hinge halves 652 and 642, thereby joining the two mast sections.

As shown in FIG. 6B, pin 546 may be removed from at least one of the hinges along axis 600 to enable track slide 392 to pass through hinge assembly 540 along tracks 520 and 530. Thus, where hinge assembly 540 is used as hinge assembly 310, track 520 may be extended onto base section 164 to enable the track to reach closer to the boom for furling and unfurling the sail.

FIG. 6C, by contrast, shows a hinge assembly including two hinges that each have separate pings 646 and 656. Thus, the hinge assembly of FIG. 6C can be used to enable a track slide to travel along a track section passing between hinges 640 and 650, without requiring the user to remove a pin.

Figure 7C:
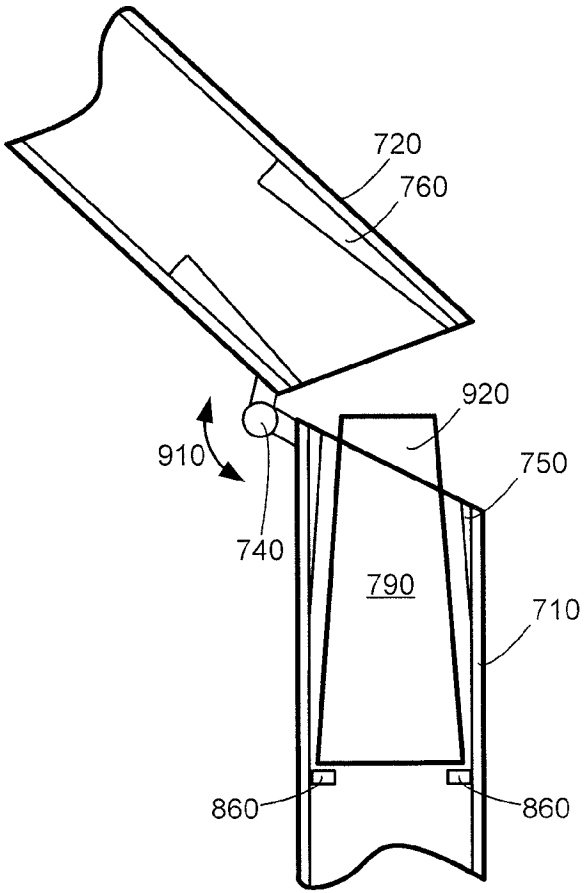
FIGS. 7A-7C illustrate an example approach for locking two mast sections of the mast assembly.
Figure 7B:
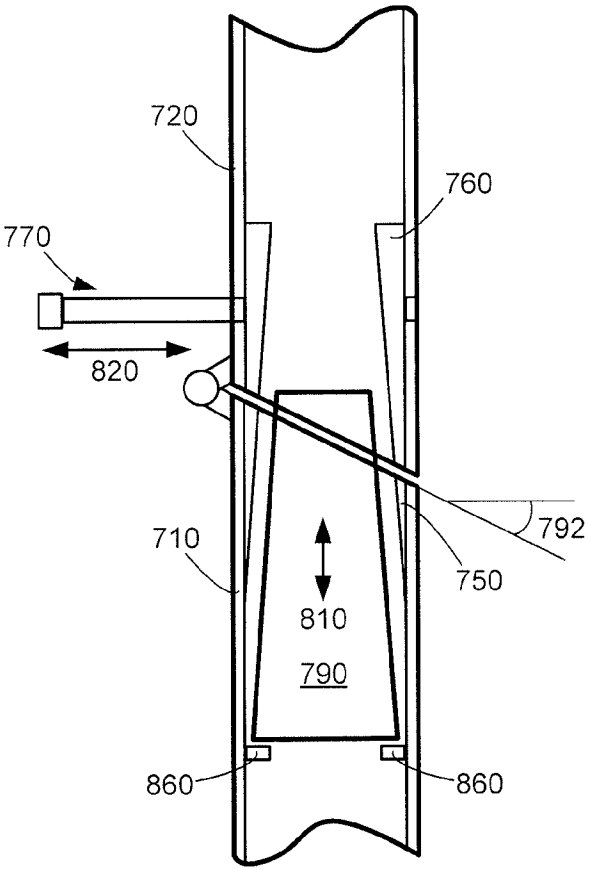
Figure 7A:
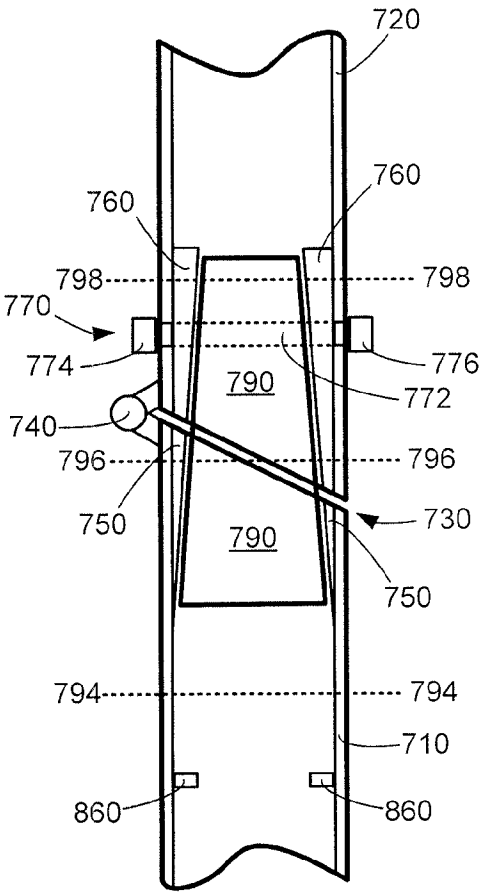

FIGS. 7A, 7B, and 7C illustrate an example approach for locking two mast sections of the mast assembly. In the example of FIG. 7, a moveable insert 790 internal the mast assembly can be translated between a locked position shown in FIG. 7A and an unlocked position shown in FIGS. 7B and 7C. However, it should be appreciated that other approaches for locking two mast sections may be used. For example, two mast sections may be locked by using a collar that is coupled to the outer surface of the mast assembly and overlaps the two mast sections.

An example interface 730 between mast sections 710 and 720 is illustrated. Interface 730 may be used to refer generically to interface 174 (e.g. between base section 164 and intermediate section 166) and interface 176 (e.g. between intermediate section 166 and upper section 168). Mast sections 710 and 720 may be moveably coupled or more specifically rotationally coupled via a hinge assembly 740 which can be used to refer to either of the previously described hinge assemblies 310, 320, or 540.

As shown in FIGS. 7A, 7B, and 7C, each interface of the mast assembly may include a fixed insert arranged within an interior region of the mast sections in the vicinity of the interface. For example, mast section 710 may include fixed insert 750 having an outer surface in contact with an inner surface of the wall of mast section 710. Insert 750 can include an inner surface that tapers in a particular direction along the longitudinal axis of the mast assembly. However, in some examples, the inner surface of insert 750 may be parallel to the wall of the mast section or may not taper. Note that where the mast sections taper with increasing height of the mast, the inner surface of the insert may taper at the same or different amount as the interior wall surface of the mast section. The insert can include an inner surface having any suitable cross-section including elliptical, ovular, square, circular, or rectangular, among others. As will be described in greater detail, fixed inserts 740 and 750 can be configured to receive moveable insert 790 having a substantially similar cross-section as the inner surface cross-section of the fixed inserts, when in the locked position. In some examples, a locking pin 770 or other suitable locking device may be used to retain moveable insert 790 in the locked position.

Further, an upper surface or edge of fixed insert 750 can be configured along the same plane with an upper surface or edge of mast section 710. For example, where a section of the mast includes an end that is angled relative to a plane orthogonal to the longitudinal axis of the mast, the upper edge of the insert can also have a similar angle and can reside in the same plane. Insert 750 can also include an inner surface having a similar cross-section as insert 740 and may be tapered at the same angle.

Mast section 720 may include an insert 760 that has a lower edge or surface that is within the same plane as the lower edge or surface of mast section 760. Further, insert 760 may also include an outer surface that is in contact with or contiguous with the inner wall surface of mast section 760 and an inner surface that tapers inward toward the longitudinal axis of the mast at the same or greater amount as the walls of the mast sections.

In this manner, when mast sections 710 and 720 are arranged along the same axis, the inner surfaces of inserts 750 and 760 may be aligned, thereby forming a substantially continuous inner wall of the mast assembly across interface 730. Note that inserts 750 and 760 may be secured to mast sections 710 and 720 respectively, utilizing any suitable method of fastening, and may include the use of adhesives, welds, and/or fasteners. In some examples, inserts 750 and 760 may be press-fitted into mast sections 710 and 720, respectively. As yet another example, insert 750 may be integrated into the inner surface of mast section 710, for example, where they are molded or formed from the same piece of material. Similarly, insert 760 may be integrated into the inner surface of mast section 720 in some examples.

As one non-limiting example, the mast sections and their respective inserts may be manufactured by cutting the mast at an angle indicated at 792 (e.g. 30 degrees). At the interface between the two mast sections, a sleeve may be fitted into the inside of the mast shell and secured utilizing any suitable approach. The inserted sleeve may be cut at the same angle as the mast section so that the interface of the mast sections including their respective inserts form a flush boundary with the ends of the mast sections. Note that angle 792 may be any suitable angle. For example, angle 792 may include an angle between 0 degrees (as shown in FIG. 9A) and 50 degrees or even greater angles. In other examples, the angle may be oriented in an opposite direction relative to the axis of rotation through hinge assembly 740. For example, angle 792 may be a negative angle.

When moveable insert is set in the locked position illustrated in FIG. 7A, for example, where the mast assembly is in an erect position, moveable insert 790 may be positioned across the interface between the two mast sections to inhibit rotation of section 710 relative to 720 about hinge assembly 740. Furthermore, as a more specific example, moveable insert 790 may include a tapered outer surface that substantially matches the inner surface of the mast assembly so that it creates a press fit with the inner surface of the fixed inserts 750 and 760. In this manner, two mast sections may be joined together to form a single mast section. Note that in some examples, moveable insert 790 may not be tapered where the inner surface of the mast is not tapered, or may be tapered in the opposite direction where the inner surface of the mast inserts are so tapered.

Conversely, where rotation of mast section 710 relative to mast section 720 is desired, moveable insert 790 may be translated along axis 810 away from the locked position. Thus, as illustrated by FIGS. 7B and 7C, the moveable insert may be drawn downward from the locked position of FIG. 7A to enable rotation of mast section 720 about hinge 740 as indicated by vector 910.

In some examples, moveable insert 790 may include a locking system 770 for maintaining the position of the moveable insert in the locked or unlocked position. For example, moveable insert 790 and at least one of the mast sections may include a bore indicated at 772 for accepting a pin or key 774. Further, pin 774 may include a lock indicated generally at 776 for inhibiting the removal or translation of pin 774 from the mast assembly. Thus, where pin 774 is inserted through bore 772, insert 790 may be constrained to the position illustrated by FIG. 7A, while pin 774 may be removed from bore 772 along axis 820 to enable the translation of moveable insert 790 to the unlocked position. Note that pin 774 may reside on a different axis through the mast assembly than the axis of the track for receiving the sail. Furthermore, in some examples, two or more pins may be used to secure moveable insert 790 in the locked position. Additionally, pins may be provided to enable the moveable insert to be secured in the unlocked position shown, for example, in FIG. 7C.

Figure 8D:
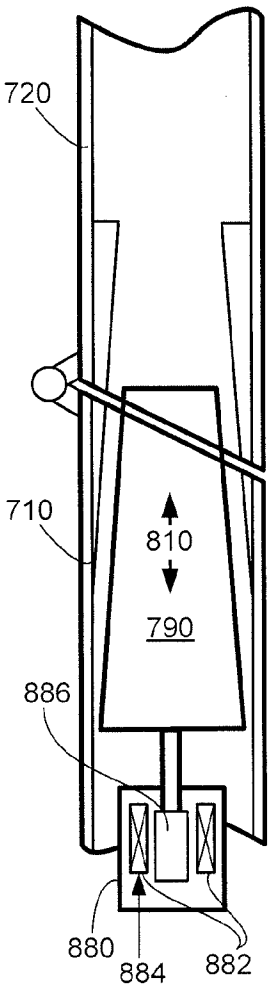
FIGS. 8A-8D illustrate several example approaches depicting how an insert within the mast assembly can be translated between locked and unlocked positions.
Figure 8C:
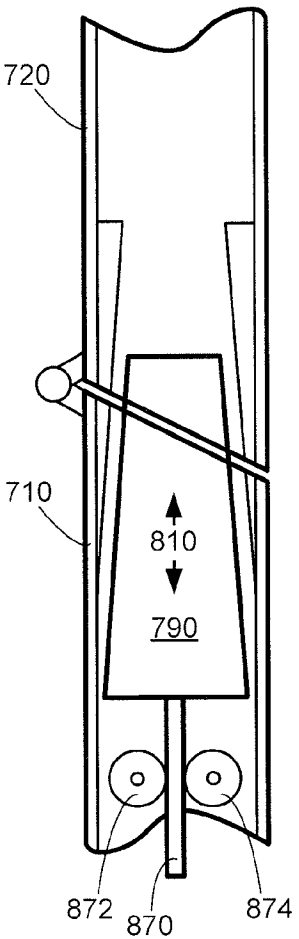
Figure 8B:
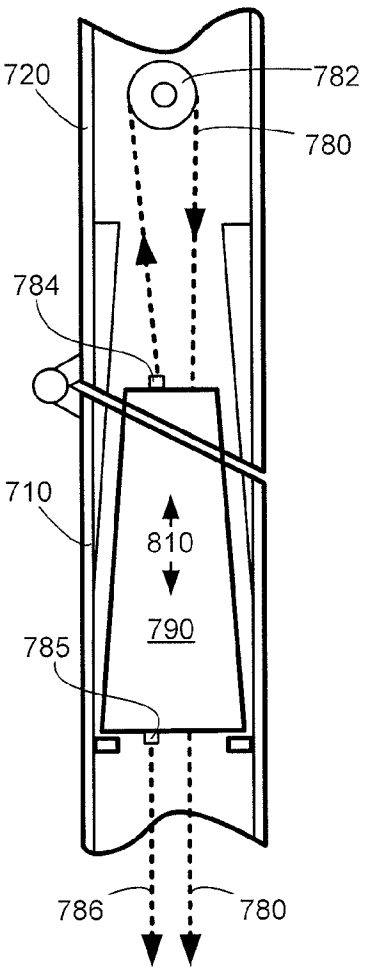

In some examples, where interface 730 is located beyond arms reach of a user from the deck surface, pin 774 may be installed by climbing the mast assembly, which may be facilitated by steps or a ladder attached to or integrated into the mast assembly. For example, section 710 may include fold-out steps to assist with the installation or removal of pin 774. Alternatively, the location of pin 774 may be controlled remotely so that manual installation or removal of the pin is not required in order to erect or fold the mast assembly. As one example, the pin may be spring loaded so that it may be inserted or removed from the mast assembly via a robe or cable. As yet another example, the pin may be electrically actuated via a solenoid, a motor, or other suitable device as shown in FIGS. 8B, 8C, and 8D.

In some examples, at least one of the mast sections may include stops indicated at 860 to inhibit moveable insert 790 from translating beyond a prescribed distance from the interface. For example, FIGS. 7B and 7C illustrate section 710 including an internal ring 860 located on the inner surface of the mast section. As moveable insert 790 is translated away from the interface, such as between the positions of FIGS. 7A and 7B, insert 790 can rest against stop 860 so that it will not translate further from the interface. The location of stop 860 may be selected so that insert 790 protrudes a predetermined distance above the upper surface or edge of section 710 as depicted in FIG. 7C at 920. The protrusion of moveable insert 790 can be used to assist in the alignment of the mast sections as the mast is erected, while the tapered or conical cross section of the insert can provide greater tolerance between fixed insert 760 and moveable insert 790 upon the initial joining of the mast sections before insert 790 is moved into the locked position illustrated in FIG. 7A. However, in other examples, stop 860 may be configured such that moveable insert 790 does not protrude above the upper surface of the mast section when it is translated to the fully unlocked position.

In some examples, the interface between two mast sections can be configured to provide deformation or deflection that is substantially similar to the deformation or deflection of remaining portions of the mast assembly. For example, the material of the moveable insert may be selected to provide a similar deformation as the remaining sections of the mast when it positioned in the locked position. In this way, the mast assembly may be configured to deform or flex along the entire length of the mast assembly through interfaces 174 and 176 as directed by any suitable function (e.g. linear, exponential, etc.).

Figure 10A:
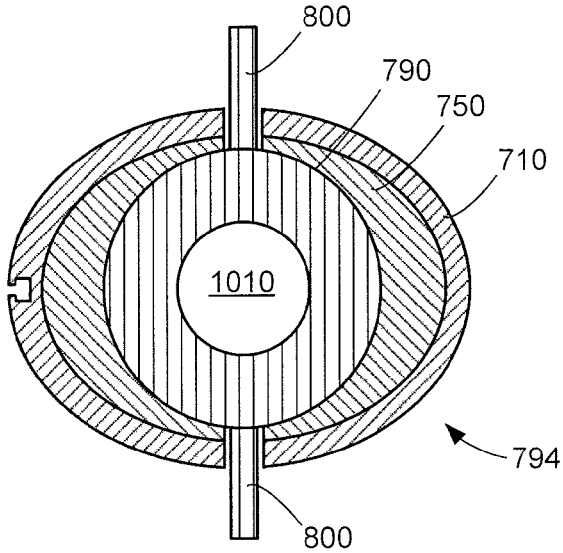
FIGS. 10A, 10B, and 10C illustrate example cross-sections of a mast assembly.
Figure 10B:
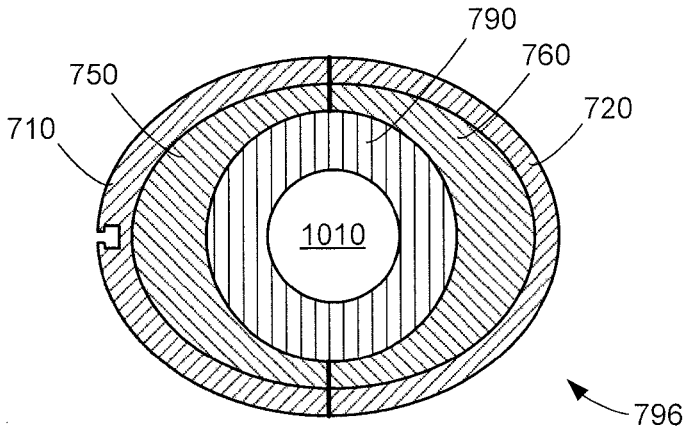
Figure 10C:
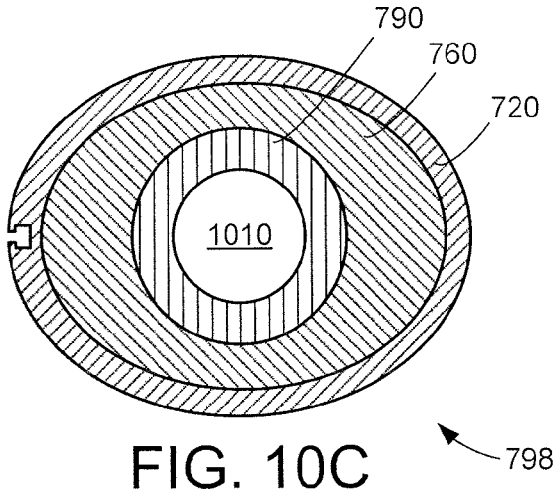

FIG. 7A also depicts the location of three example cross-sections of the mast assembly as indicated at 794, 796, and 798, which correspond to FIGS. 10A, 10B, and 10C, respectively. FIGS. 8A, 8B, 8C, and 8D depict several examples of how the moveable insert within the mast assembly can be translated between the locked and unlocked positions shown in FIGS. 7A, 7B, and 7C.

Figure 8A:
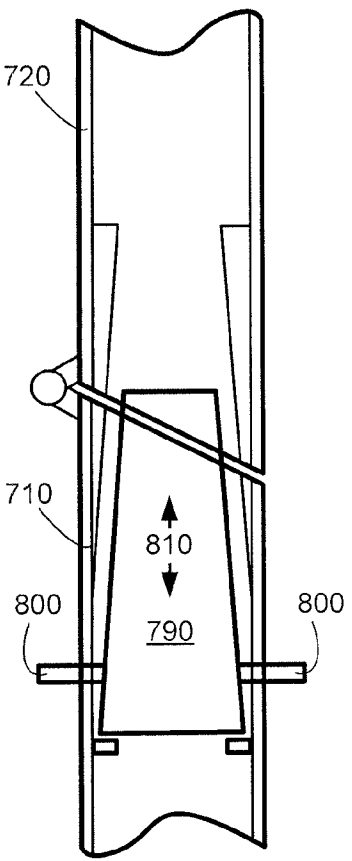

As shown in FIG. 8A, moveable insert 790 may be provided with handles 800 that protrude through channels or openings in the wall surface of the mast section to enable a user to translate moveable insert 790 along axis 810. In this particular example, a user can translate moveable insert from the un-locked position shown in FIG. 7C to the locked position shown in FIG. 7A by lifting up on handles 800. Conversely, the user can translate the moveable insert from the locked position to the unlocked position by pulling down on handles 800. Handles 800 are also be shown in FIG. 10A As shown in FIG. 8B, moveable insert 790 may be translated along axis 810 by the user via a pulley system residing internal the mast assembly. In this example, a pulley 782 may be provided with a first mast section above moveable insert 790. A first rope or cable 780 can be secured to the upper side moveable insert 790 at a first end as indicated at 784. Rope or cable 780 can pass over pulley 782 before passing through an opening defined in moveable insert 790 as shown in FIGS. 10A, 10B, and 10C. In this way, moveable insert 790 can be translated upward along axis 810 and into the locked position when the user pulls downward on rope or cable 780. Furthermore, a second rope or cable 786 may be secured to the lower end of moveable insert 790 as indicated at 785 to enable the user to remove moveable insert 790 from the locked position. For example, by pulling downward on moveable insert 790 via rope or cable 786, moveable insert 790 can be translated to the unlocked position along axis 810. In still other examples, rack 870 may be replaced by a worm gear.

As shown in FIG. 8C, moveable insert 790 may be translated along axis 810 by way of a rack and pinion. In this particular example, rack 870 may include a first end that is fixed to moveable insert 790 and a second end that is mated with one or more gears and/or rollers. For example, a first gear 872 (e.g. pinion) can mate with rack 870 and a second gear or roller 874 can mate with the opposite side of the rack. Thus, in this example, moveable insert 790 may be translated in a first direction along axis 810 by driving at least gear 872 in a first direction. Moveable insert 790 may be translated in a second opposite direction along axis 810 by driving at least gear 872 in a second opposite direction. In this way, moveable insert 790 can be translated between the locked and unlocked positions. Note that gears 872 and/or 874 can be driven by a motor (not shown) or can be driven by the user via a wheel or crank. For example, where a motor is used to drive gear 872, the motor can reside within the mast assembly and can be powered from a power source such as an electric battery stored on-board the watercraft. Alternatively, where a wheel or crank is used to drive gear 872, the mast assembly may be provided with a receptacle on an outer surface of the mast section housing the gear. The receptacle can be configured to receive and mechanically couple a wheel or crank to gear 872 to enable a user to drive or rotate gear 872 from a location external the mast assembly.

As shown in FIG. 8D, moveable insert 790 may be translated along axis 810 by way of a solenoid 880. In this particular example, solenoid 880 is disposed inside the mast assembly and is fixed to an inner wall of a mast section. Solenoid 880 can include one or more coils indicated at 882 and an armature indicated at 886. Armature 886 can be coupled with moveable insert 790. Electrical energy can be provided to coil 882 as indicated at 884 to cause armature 886 to translate along axis 810. By varying a characteristic of the electrical energy provided to the solenoid, the position of moveable insert 790 can be varied between the locked and unlocked positions.

While various example approaches have be provided for locking and unlocking two mast sections, it should be appreciated that other suitable approaches may be used. Furthermore, in some examples, each interface between two mast sections of the mast assembly can utilize the same approach for translating the moveable insert. Alternatively, in some examples, a first interface (e.g. between sections 164 and 166) may utilize a different approach than a second interface (e.g. between sections 166 and 168). For example, the handles shown in FIG. 7A can be used for the lower interface between sections 164 and 166, while one of the approaches shown in FIG. 8B, 8C, or 8D can be used at the upper interface between sections 166 and 168 where it may be more difficult for the user to access due to the increased height of the interface above the deck of the watercraft.

Figure 9C:
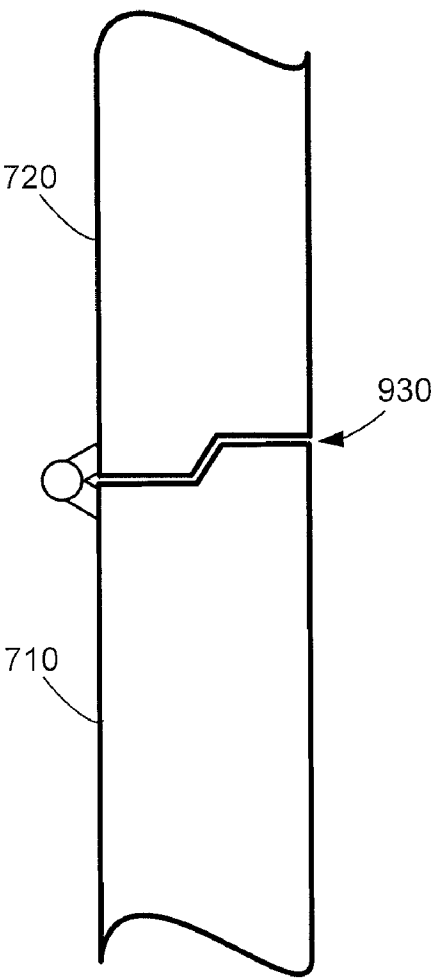
FIGS. 9A, 9B, and 9C illustrate alternative examples for an interface between two mast sections.
Figure 9B:
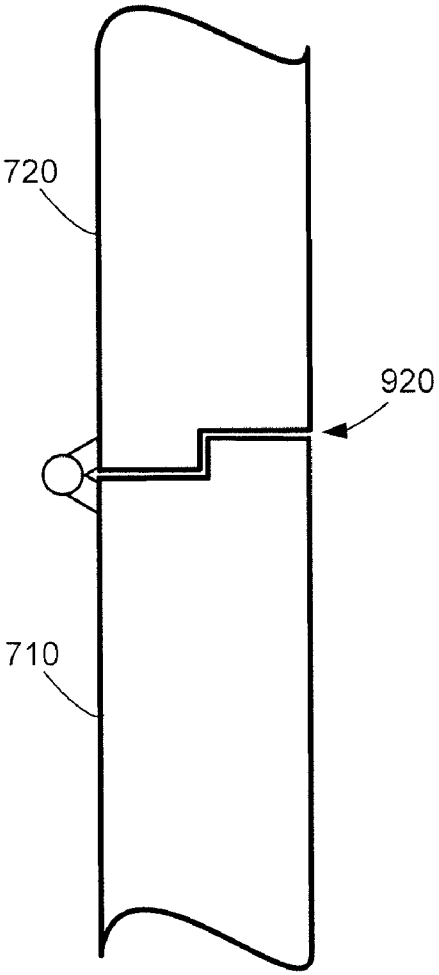
Figure 9A:
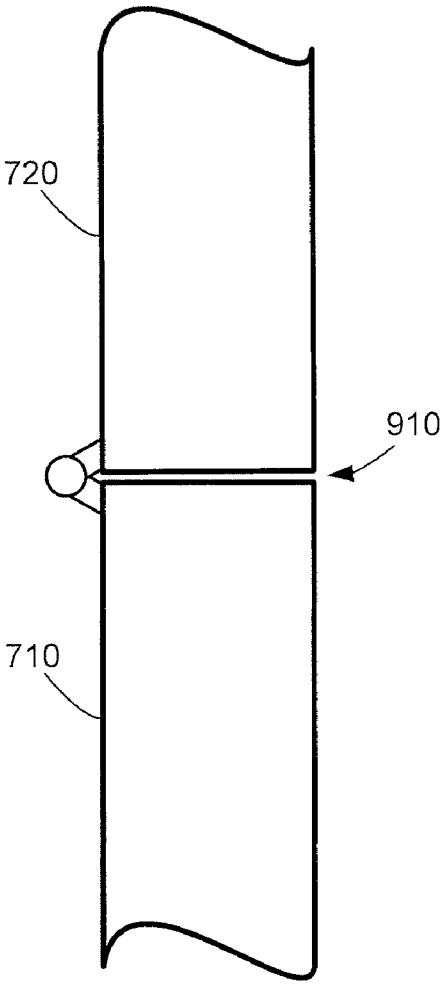

FIGS. 9A, 9B, and 9C show alternative examples of the ends of the mast sections at an interface of the mast assembly. As shown in FIG. 9A, interface 910 can be normal to the longitudinal axis of the mast assembly. As shown in FIGS. 9B and 9C, the interface between two mast sections may include a first diametral cut approximately halfway through the mast section from a first surface of the mast assembly, followed by a longitudinal cut along the axis of the mast assembly, followed by a second diametral cut approximately halfway through the mast section from a second surface of the mast assembly. As shown in FIG. 9B, interface 920 shows an example where the first and second diametral cuts are substantially normal to the longitudinal axis of the mast assembly, while the longitudinal cut is substantially parallel to and/or collinear with the longitudinal axis of the mast assembly. As shown in FIG. 9C, interface 930 shows an example where the longitudinal cut is angled relative to the longitudinal axis of the mast assembly. In still other examples, the first and/or second diametral cuts may be angled relative to the longitudinal axis whereby the longitudinal cut is either parallel to or angled relative to the longitudinal axis. It should be appreciated that interfaces 910, 920, and 930 can refer to the interface between any two mast sections described herein.

FIG. 10A depicts a cross-section of the mast assembly below interface 730 as indicated at 794. In this particular example, wall 710 of the lower mast section has an elliptical shape. However, in other examples, the mast sections can have other shapes including circular, rectilinear, or other suitable shapes, including an airfoil configuration. Further, it should be appreciated that the diameter, circumference, and/or cross sectional area of the mast assembly can decrease along the longitudinal axis of the mast assembly as the distance from the deck of the watercraft increases. Thus, the mast sections can taper from the lower end to the upper end of each section. Wall 710 is shown defining or including a track 1000 for accepting the sail as shown in FIG. 3.

Insert 750 is shown in FIG. 10A forming an interface between the non-circular inner surface of wall 710 and the circular outer surface of moveable insert 790. In this way, insert 750 can be configured to accommodate any suitable shape of wall 710 and moveable insert 790. Moveable insert 790 is also shown defining an opening 1010 for enabling ropes, communication cables, and/or electrical wiring to pass through the moveable insert 790. Alternatively or additionally, insert 750 may define one or more openings between wall 710 and moveable insert 790 for passing any suitable rope, cable, or wiring.

Furthermore, FIG. 10A depicts handles 800 that were previously described with reference to FIG. 8A for enabling a user to translate moveable insert 790 upward or downward to lock or unlock the mast assembly. Note that handles 800 can be omitted in some examples, such as where an alternative approach for translating moveable insert 790 within the mast assembly is used as previously described with reference to FIGS. 8B, 8C, and 8D, for example. Track 520 or 530 is shown in each of cross sections 10A-10C.

FIG. 10B depicts a cross-section of the mast assembly through interface 730 as indicated at 796. In this example, walls 710 and 720 of the two mast sections are depicted on either side of interface 730. Additionally, insert 760 is shown disposed between wall 720 and moveable insert 790 in a similar configuration as previously described with reference to insert 750. Track 1000 is shown continuing through interface 730.

FIG. 10C depicts the cross-section of the mast assembly above interface 730 as indicated at 798. A comparison of FIGS. 10A, 10B, and 10C illustrates how moveable insert 790 can have a conical or tapered cylinder configuration along the vertical axis of the mast assembly. Similarly, insert 750 can define an inner surface that corresponds to the approximate conical shape or tapered cylinder configuration of the moveable insert 790. In this way, insert 750 can accommodate moveable insert 790 in the locked position to reinforce and support the mast assembly through interface 730 against lateral loading. Track 1000 is also shown continuing along the upper mast section of the mast assembly for accommodating the sail.

Figure 11:
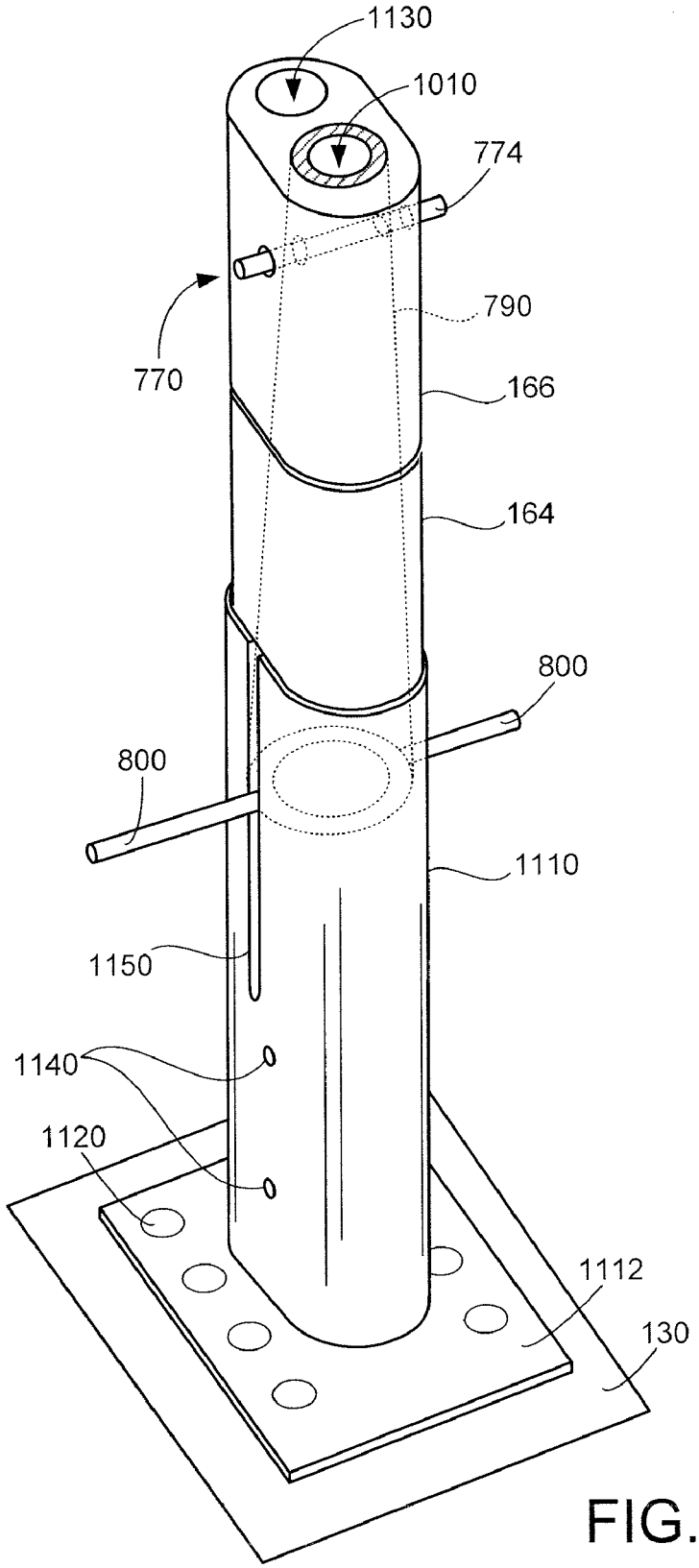
FIG. 11 shows an example of a mast stepping support for the mast assembly.

FIG. 11 provides a detailed view of a non-limiting example of a mast assembly including a mast stepping support 1110. Note that mast stepping support 1110 can refer to mast stepping support 380 previously described with reference to FIG. 3A. As shown in FIG. 11, mast stepping support 1110 can be adapted to receive a first end of mast section 164. Mast section 164 can be secured to the mast stepping support 1110 via one or more fasteners that may be removable by the user to enable the mast to be unstepped. As one example, a plurality of openings indicated generally at 1140 may be provided that corresponding to openings in mast section 164. Openings 1140 can be adapted to receive any suitable fastener, including bolts, pins, screws, etc. Mast stepping support 1110 may in turn be secured to deck 130 via one or more fasteners indicated at 1120 through base plate 1112. However, in other examples, mast stepping support 1110 may be permanently secured to the deck via base plate 1112 by welds, adhesives, or may be integrally formed with the deck or hull of the watercraft.

In some examples, mast stepping support 1110 may include a channel indicated at 1150 for enabling handles 800 that are operatively coupled with moveable insert 790 to be accessible by the user. As previously described with reference to FIG. 8A, handles 800 can be used to translate moveable insert 790 relative to mast sections 166 and 168, to thereby lock or unlock the interface between the mast sections. In some examples, handles 800 may be removable from insert 790. For example, handles 800 may include threaded ends that can be screwed into a corresponding threaded receptacle in insert 790. As yet another example, handles 800 may fold relative to moveable insert 790 and stepping support 1110. For example, handles 800 may be folded from the position shown in FIG. 11 to a position where they are substantially parallel to stepping support 1110.

As indicated at 770, the moveable insert may be retained in the locked position via a pin 774 or other suitable device. As indicated at 1010, the moveable insert may include an opening to enable wires, cables, or ropes to pass through the mast assembly. Furthermore, as indicated at 1130, the mast sections may include other openings to enable wires, cables, or ropes to pass through the mast assembly without requiring that they pass through the moveable insert.

Figure 12A:
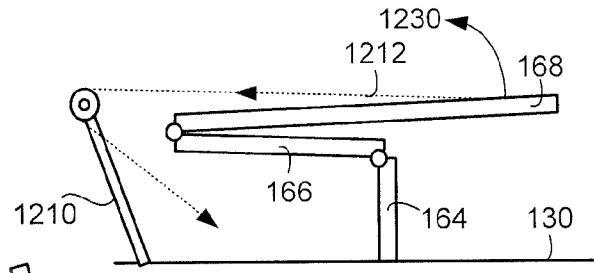
FIGS. 12A-12E illustrate an example approach for reconfiguring the mast assembly.
Figure 12D:
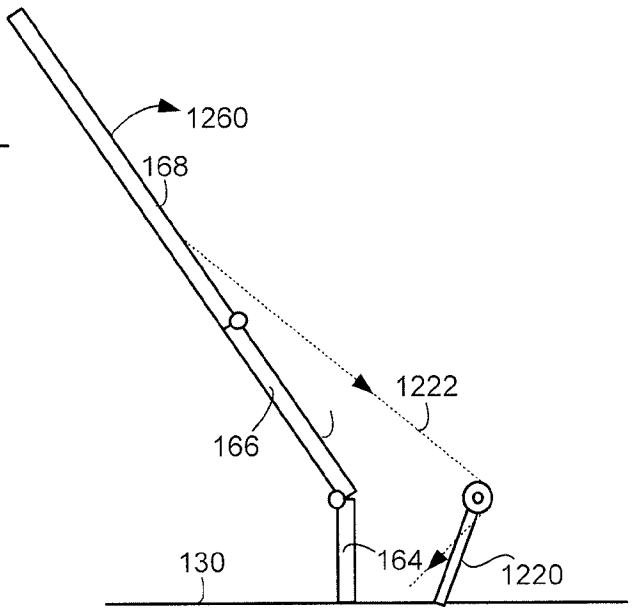

While FIGS. 3A-3C show one example approach for reconfiguring the mast assembly, FIGS. 12A-12E show yet another example. Referring to FIG. 12A, the mast assembly may be initially configured in the folded configuration. A first post 1210 including a pulley or eyelet can be used to raise mast section 168 via rope or cable 1212 as indicated by vector 1230. Rope or cable 1212 can be pulled to induce rotation of mast section 168 by the user and/or by a winch. In some examples, deck surface 130 may include a receptacle or opening for receiving the base end of post 1210 at a suitable location relative to the mast assembly to enable the mast to be erected. Note that where mast section 168 is situated in a substantially horizontal position, a jack may optionally be used to initially lift the top end of mast section 168 so that it may be rotated to the position shown in FIG. 12B by way of rope or cable 1212.

Figure 12B:
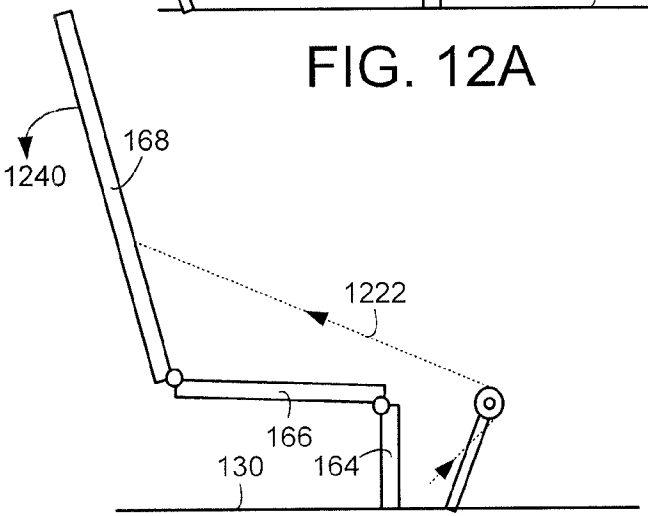
Figure 12E:
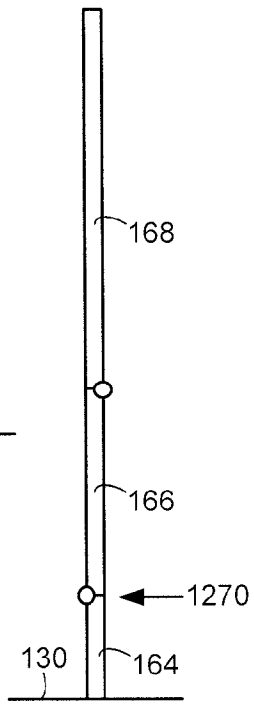
Figure 12C:
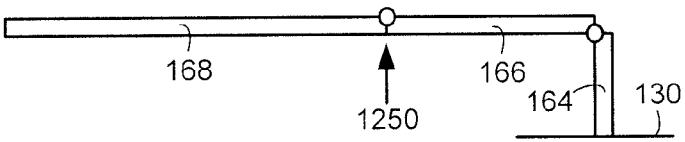

As shown in FIG. 12B, when mast section 168 passes the vertical plane, a second post indicated at 1220 including a pulley or eyelet can be used to slow the rate of decent of mast section 168 via a rope or cable 1222 as indicated by vector 1240. Once mast section 168 is lowered to the position shown in FIG. 12C, mast sections 168 and 166 are substantially aligned or collinear to enable the two mast sections to be locked as indicated at 1250. One advantage of this approach is that a user can more easily reach the locking device from the surface of the deck rather than attempting to lock mast sections 168 and 166 when the mast assembly is in the fully erected position.

Once mast sections 168 and 166 are locked, post 1220 may be used to rotate mast sections 168 and 166 relative to mast section 164 as indicated by vector 1260. Again, it should be appreciated that the user and/or a winch may be used to facilitate the repositioning of the mast sections via rope or cable 1222. Once mast sections 168 and 166 are rotated to the fully erected position, mast sections 166 and 164 are substantially aligned or are collinear. Thus, mast sections 166 and 164 can be locked as indicated at 1270.

The approach shown in FIG. 12 can be reversed to move the mast assembly to the folded configuration from the erected configuration. In this way, a user can reconfigure the mast assembly without requiring that the user climb the mast to lock mast sections 166 and 168.

Figure 13:
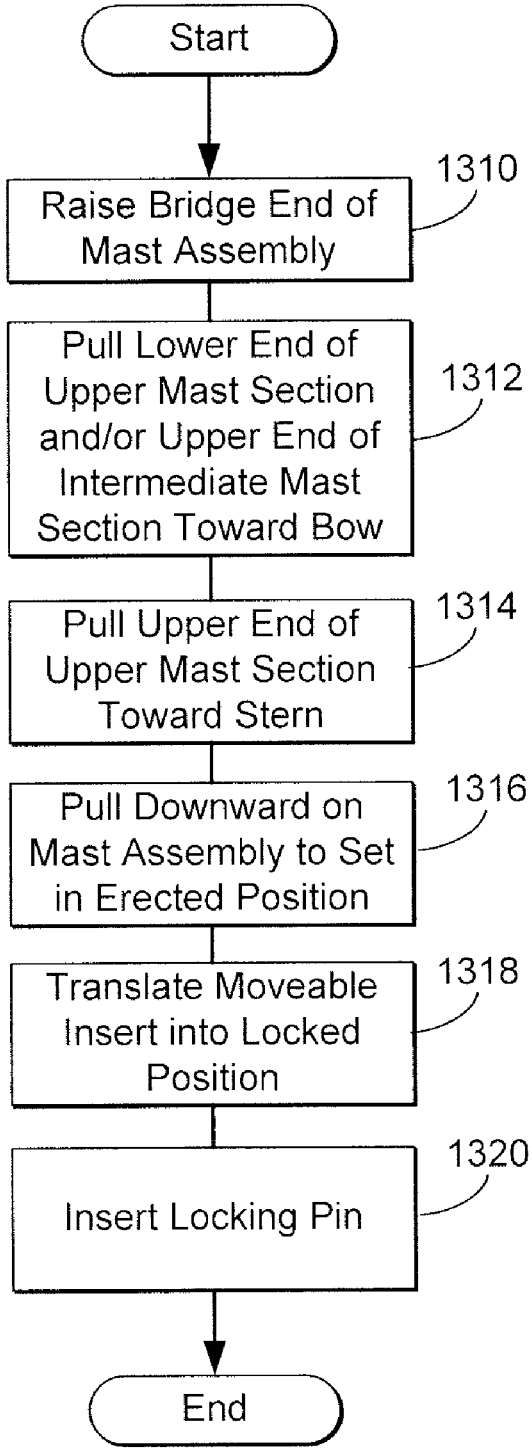
FIG. 13 illustrates another example approach of reconfiguring the mast assembly.

Referring now to FIG. 13, an example method is provided for erecting a mast assembly including three mast sections, using an alternative approach as shown in FIGS. 3A-3C. Note that the methods described herein for erecting or lowering the mast to the folded configuration can be facilitated by one or more winches and may be at least partially controlled via a control system as will be described in greater detail with reference to FIG. 17. In some examples, a multi-purpose winch may be used to raise and lower the mast assembly and/or raise or lower the keel as will be described below. Alternatively, one or more winches may be dedicated to the raising and lowering of the mast assembly. Further, it should be appreciated that any suitable winch or assisting device may be utilized to perform the operations described herein, including motorized winches and/or hand operated winches, among others.

At 1310, the bridge end of the mast assembly may be raised from its cradle. As one non-limiting example, a hydraulic jack 590 may be operated to raise the intermediate section of the mast assembly (e.g. section 166 or section 168) to a suitable angle (e.g. 30 degrees or more) with reference to the horizontal axis. At 1312, the lower end of the upper mast section (e.g. section 168) and/or the upper end of the intermediate mast section may be pulled toward the bow of the watercraft, for example, by utilizing a winch. At 1314, the upper end of the upper mast section may be pulled toward the stern. At 1316, a cable or rope passing through the center of the mast assembly and attached to the upper mast section may be pulled downward to set the mast in the erected position, for example, as illustrated in FIG. 3. At 1318, each of the moveable inserts may be translated into the locked position, for example, by pulling on cable 780 passing over pulley 782. Note that each moveable insert may include its own set of locking and unlocking cables. At 1320, a locking pin may be inserted into each of the moveable inserts to secure their position. In this way, a mast assembly comprising two or more sections may be erected.

Figure 14:
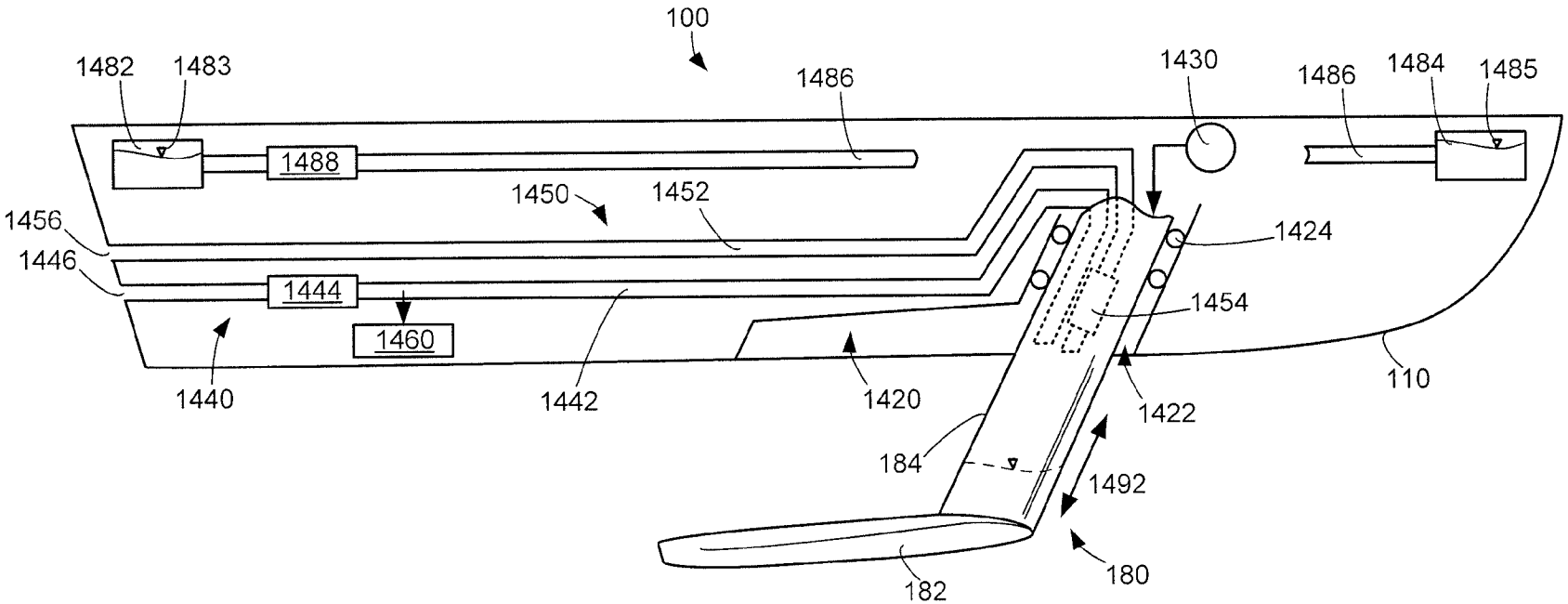
FIG. 14 illustrates an example watercraft including a keel deployment system and a variable ballast system, whereby the keel is deployed.
Figure 15:
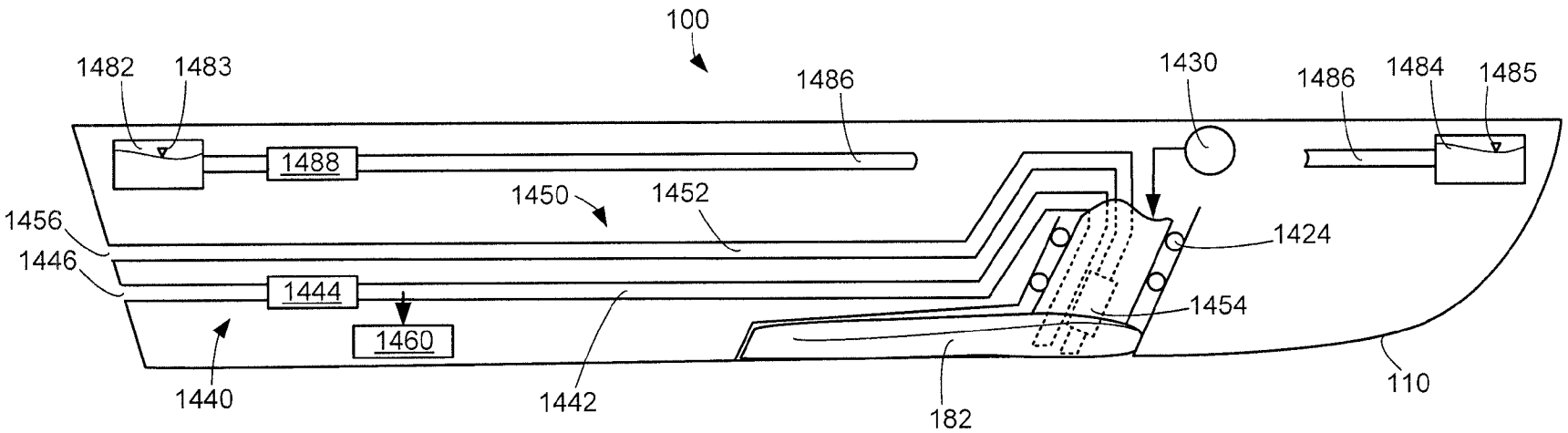
FIG. 15 illustrates the watercraft of FIG. 14, whereby the keel is retracted.
Figure 16:
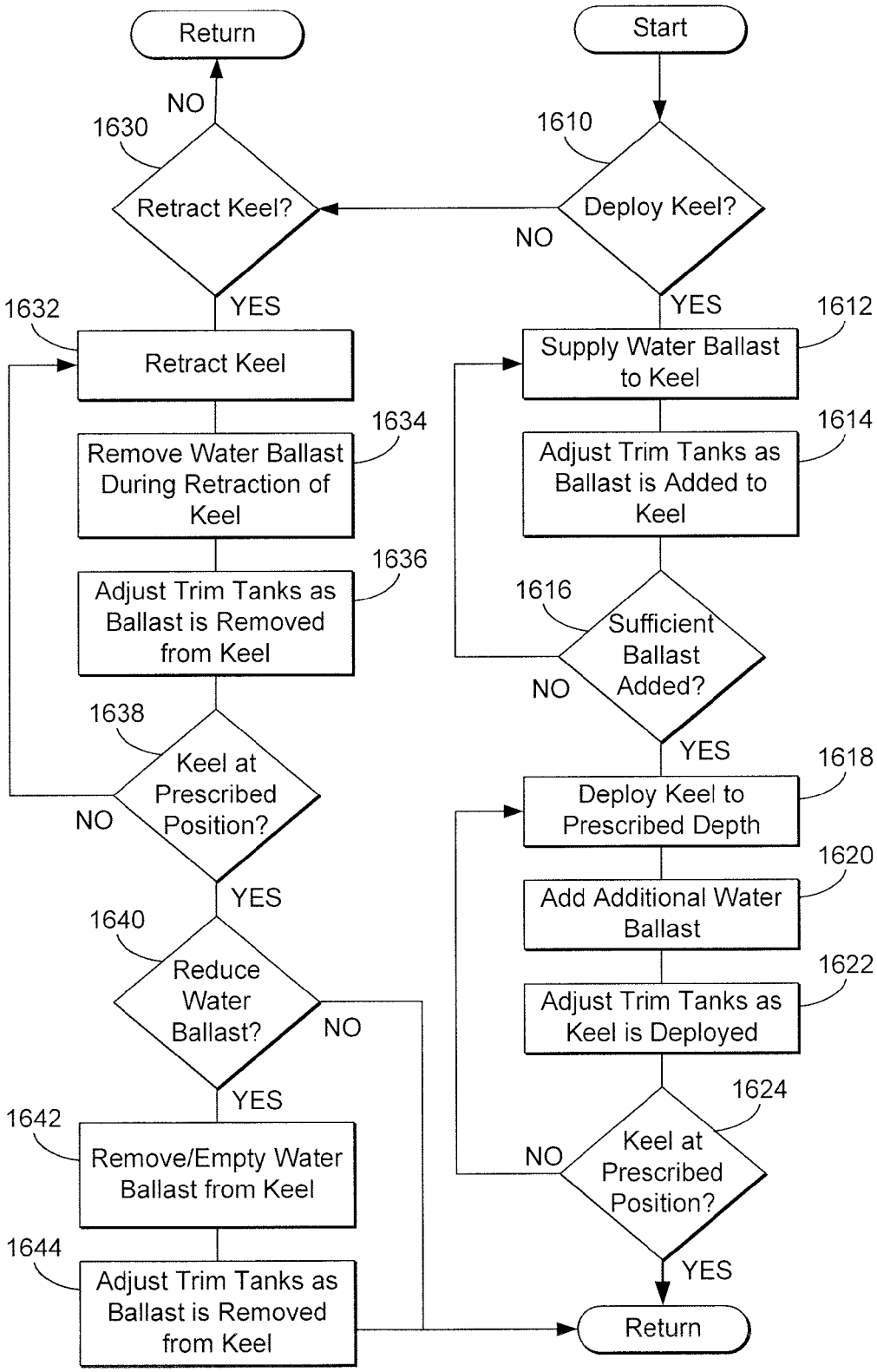
FIG. 16 illustrates an example method of deploying the keel and/or adjusting the amount of ballast stored by the keel.

Turning now to the keel, FIGS. 14-16 illustrates various approaches for deploying/retracting the keel and/or adjusting the amount of ballast stored in the keel. In particular, FIG. 14 illustrates a side profile view of keel 180 in a deployed configuration and FIG. 15 illustrates keel 180 in a fully retracted configuration with reference to hull 110 of watercraft 100. In this particular embodiment, keel 180 includes a bulb 182 and an arm 184. By deploying keel 180, the lateral resistance of the watercraft may be increased and/or the center of mass of the watercraft may be lowered by adding or removing water ballast from the keel. Further, rear trim tank 1482 and/or front trim tank 1484 may be utilized to adjust the trim of the water craft at least during adjustment of the keel position and/or ballast.

Arm 184 of keel 180 can pass through the lower surface of hull 110 via channel 1422. In some embodiments, channel 1422 can include one or more seals for reducing water entrainment into the upper regions of the channel. The position of keel 180 can be controlled by varying the position of the arm relative to winch 1430 as indicated by vector 1492, thereby deploying (e.g. lowering) or retracting (e.g. raising) keel 180 relative to hull 110. The arm of the keel may be translated based on winch position utilizing any suitable configuration. As one example, a worm gear or rack and pinion may be utilized to raise or lower the keel. Further, one or more guides such as rollers 1424 or other suitable device can be utilized to facilitate the translation of arm 184 relative to channel 1422. Note that winch 1430 can include a motorized winch that is powered by an electric motor or internal combustion engine or may include a hand winch that is powered by a human operator. Where a motorized winch is utilized, a control system, as will be described in greater detail with reference to FIG. 17, may be used to control the winch operation and position. The position of keel 180 can be continuously variable relative to the hull, or may be adjusted between one or more discrete positions between the fully deployed and fully retracted configurations illustrated in FIGS. 14 and 15, respectively. Further, in some embodiments, the keel may include a locking device for locking the position of the keel, thereby inhibiting translation of the keel during operation of the watercraft.

As illustrated in FIG. 15, where keel 180 is retracted into region 1420, the lower surface of bulb 182 can define at least a portion of the lower surface of hull 110. As one non-limiting example, a keel including a bulb can comprise between 15% and 40% of the longitudinal length of the watercraft. However, it should be appreciated that the keel and/or bulb may comprise less than 15% or greater than 40% of the length of the watercraft. Thus, in some embodiments, the lower surface of hull 110 can be varied by deploying or retracting the keel. Further, in some embodiments, where keel 180 is at least partially deployed from hull 110, one or more removable doors or shields may be utilized to cover region 1420 in order to define the hull and/or reduce drag on the hull. For example, hull 110 can be configured as a displacement hull where keel 182 is deployed and may be configured as a planning hull when keel 180 is retracted. A further description of the doors for covering region 1420 will be described in greater detail with reference to FIGS. 22 and 23.

Further, FIGS. 14 and 15 schematically illustrate an example variable ballast system for adding or removing water from the keel of the watercraft. For example, watercraft 100 may include a ballast intake system 1440 for supplying water to the bulb of the keel from the ambient water surrounding the watercraft and a ballast removal system 1450 for removing water ballast from the keel to the ambient surrounding water.

Ballast intake system 1440 can include a pump 1444 arranged along an intake passage 1442 connected to an intake port 1446 located on the surface of hull 110 beneath the water line. Pump 1444 can be operated to transfer water from the ambient water surrounding the hull into an internal space within the keel (e.g. bulb 182) via intake passage 1442. For example, intake passage 1442 can transfer water to bulb 182 via arm 184. Ballast removal system 1450 can also include a pump 1454 arranged along a removal passage 1452 connected to an exhaust port 1456 located on the surface of the hull. Pump 1454 can be operated to transfer water from the keel via arm 184.

While not illustrated in FIG. 14 or 15, the water intake and/or removal systems may include one or more valves for facilitating the control of water flow. Note that while FIGS. 14 and 15 illustrate separate ballast intake and ballast removal systems, it should be appreciated that a single combined water passage and/or combined pump may be used to supply water to and remove water from the keel. For example, a single reversible pump may be operated to increase or decrease the water ballast of the watercraft. Further still, intake or removal passages 1442 and/or 1452 may be utilized to supply water to other systems of the watercraft indicated generally at 1460 such as for example for use with a shower, sink, toilet, etc.

In the particular embodiment illustrated in FIGS. 14 and 15, arm 184 may be angled relative to the vertical axis. As one non-limiting example, the lower end of arm 184 may be angled approximately 30 degrees toward the rear of the watercraft relative to the vertical axis. It should be appreciated that alternative arm and/or bulb configurations for the keel will be described in greater detail with reference to FIGS. 18 and 19. Where an angled arm is utilized, such as illustrated in FIGS. 14 and 15, the relative position of the bulb may be translated rearward upon deployment of the keel and may be translated forward upon retraction of the keel.

As keel 180 is deployed or retracted, the location of the ballast stored in the keel may be translated forward or rearward relative to the longitudinal direction of the watercraft. This translation of ballast may cause the center of mass of the watercraft to shift accordingly. As such, FIGS. 14 and 15 further illustrate a trim system for trimming the watercraft. For example, watercraft 100 may include a front trim tank 1484 and/or a rear trim tank 1482 for storing water as ballast for trimming the watercraft. The front and rear trim tanks can communicate via at least one transfer passage 1486 and may include at least one pump 1488 for facilitating the transfer of water between the front trim tank 1484 and the rear trim tank 1482. Front trim tank 1484 may include a water depth sensor 1485 for sensing the depth and hence the amount of water stored in the trim tank. Similarly, rear trim tank 1482 may include a water depth sensor 1483. Note that in some embodiments, the watercraft may not include a front and/or rear trim tank, or may alternatively include two or more front and/or rear trim tanks.

Where the front of the watercraft is to be raised relative to the rear of the watercraft, water stored by the front trim tank may be reduced and/or water stored by the rear trim tank may be increased accordingly. Similarly, where the rear of the watercraft is to be raised relative to the front of the watercraft, water stored by the rear trim tank may be reduced and/or water stored by the front trim tank may be increased accordingly.

Referring now to FIG. 16, an example method for operating the keel is described. At 1610, the system illustrated in FIGS. 14 and 15 may be controlled differently depending on whether the keel is to be retracted (e.g. translated toward the hull) or deployed (e.g. translated away from the hull). For example, if the keel is to be deployed, then water may be supplied to the keel at 1612 to increase the ballast of the keel. For example, water may be pumped from the ambient water surrounding the hull by an intake passage to the keel. Note that the keel and/or hull may include permanent ballast in addition to the variable ballast provided by the water. Such permanent ballast may include any suitable material including lead, steel, water, etc.

In response to the addition of ballast to the keel, the front and/or rear trim tanks may be adjusted at 1614 to maintain a prescribed trim on the watercraft. For example, where the keel in the retracted configuration is forward of the center of mass of the watercraft, the watercraft may begin to pitch forward where ballast is added to the keel. As such, water may be supplied to the rear trim tank and/or water may be removed from the front trim tank to compensate for the addition of ballast to the keel. Alternatively, where the keel is located rear of the center of mass of the watercraft, the watercraft may being to pitch rearward where ballast is added to the keel. As such, water may be supplied to the front trim tank and/or water may be removed from the rear trim tank to compensate for the addition of ballast to the keel.

Where it is judged that the keel is filled with a prescribed amount of water for deployment of the keel, the keel may be deployed at 1618, for example, by operating a winch to lower the keel from the hull. Alternatively, if it is judged that an insufficient amount of ballast has been added to the keel, then additional water may be supplied to the keel at 1612 and additional adjustment of the trim tanks may be utilized at 1614 to trim the watercraft.

Where the keel is deployed at 1618, additional ballast may be added at 1620 during and/or after deployment. Further, the trim tanks may be adjusted at 1622 as the keel is deployed and/or additional ballast is added to the keel to maintain a prescribed trim on the watercraft. Where the keel is deployed at an angle relative to the vertical axis, the center of mast may shift forward or rearward. As such, the trim tanks may be adjusted accordingly. For example, where the arm of the keel is angled at approximately to the rear of the watercraft, as illustrated in FIGS. 14 and 15, the center of mast may shift toward the rear of the hull upon deployment of the keel, which may cause the watercraft to pitch rearward. Therefore, water may be removed from the rear trim tank and/or added to the front trim tank in order to compensate for the deployment and/or addition of ballast to the keel.

If it is judged that the keel is deployed to the prescribed depth at 1624, the routine may return or end. Alternatively, where the keel is not fully deployed, the winch or other suitable assisting device (e.g. motor, jack, solenoid, etc. may be operated to translate the keel further from the hull at 1618, where additional ballast may be added at 1620 and/or adjustments to the trim tanks may be performed at 1622. Note that the position of the keel may be determined by a position sensor located on the keel arm, the gears controlling the keel position, or the winch or assisting coupled thereto. Alternatively, the depth of the keel may be determined by visual inspection.

Returning to 1610, where it is instead judged that the keel is to be retracted at 1630, the winch may be operated to retract the keel to the prescribed depth at 1632 while the trim tanks may be adjusted accordingly at 1636 in order to maintain the prescribed trim on the watercraft. Further, the amount of ballast may be reduced by removing water from the keel. For example, where the keel is retracted in the forward direction at an angle relative to the vertical axis, the center of mass may shift forward. As such, the amount of water stored in the rear trim tanks may be increased and/or the amount of water stored by the front trim tanks may be decreased accordingly.

At 1638, it may be judged whether the keel is retracted to the desired depth. For example, the keel may be retracted fully into the hull such that the lower surface of the keel (e.g. bulb) forms the bottom surface of the hull. Alternatively, the keel may be only partially retracted between the positions illustrated in FIGS. 14 and 15, for example. Note that the position of the keel may be determined by a position sensor located on the keel, the gears controlling the keel position, or the winch coupled thereto. Alternatively, the depth of the keel may be determined by visual inspection. Further still, where doors or shields are used to cover the depression in the bottom hull surface, the shields or doors may be removed or opened prior to fully retracting the keel.

Note that in some embodiments, the keel may not be fully retracted, but may instead permanently reside outside of the hull structure. As such, the depressed region of the hull may not be included, whereby a channel for receiving the arm may be the only opening or depression in the hull surface. Further, where the keel position is fixed, the arm of the keel may pass through the hull surface or may be coupled to the hull surface without a surrounding channel. Thus, it should be appreciated that the features and approaches described herein may be utilized independently of each other or in combination.

Continuing with FIG. 16, if the keel has not be retracted to the prescribed position, then the keel may be further retracted at 1632, whereby further adjustments of the trim tanks at 1636 and/or reduction of the keel ballast at 1634 may be performed. Alternatively, if the keel has been retracted to the prescribed position, then it may be judged at 1640 whether to reduce the keel ballast. For example, the amount of water within the keel may be reduced or emptied to further reduce the weight of the watercraft, such as during powered operation or during transportation of the watercraft (e.g. via a trailer). Where the keel ballast is to be reduced, the ballast removal system may be operated to remove some or substantially all of the water from the keel, for example, via a pump, where it may be rejected to the ambient water surrounding the hull. As water is removed from the keel, the trim tanks may be adjusted at 1644 to compensate for the shifting of the center of mass of the watercraft.

In some embodiments, pump 1454 for removing water from the keel may be configured to reach to the lower region of the bulb only when the keel is fully retracted. In this way, water can be fully removed from the keel only where the keel is retracted, thereby serving to reduce the potential for having the keel deployed without sufficient ballast, which may cause otherwise reduced stability of the watercraft where the keel having a positive buoyancy is deployed.

In this manner, the position of the keel may be adjusted to provide different levels of lateral stabilization for the watercraft and/or the amount of ballast provided by the keel may be varied to raise or lower the center of mass of the watercraft. Further, the watercraft may utilize one or more trim tanks to compensate for adjustments to the keel position and/or weight in order to trim the watercraft.

It should be appreciated that the various approaches described above with reference to FIGS. 14-16 for deploying or retracting the keel and adjusting the quantity of water ballast within the keel may be utilized together or independently. Further, it should be appreciated that a watercraft may utilize two or more keels having some or all of the features described herein. For example, a watercraft such as a sailboat may include two keels, each of which including a variable water ballast system and each of which may be deployed or retracted. As one example, two keels may be arranged in a side by side configuration as a mirror image about the centerline of the hull and offset by the same distance from the center-line. Alternatively, two keels may be arranged in an in-line configuration. Therefore, the present application is not limited to any particular keel configuration or quantity of keels. As such, it should be appreciated that any suitable number and/or arrangement or keels are possible, whereby each of the keels may include a variable ballast system and/or may be deployed/retracted as described herein.

Figure 17:
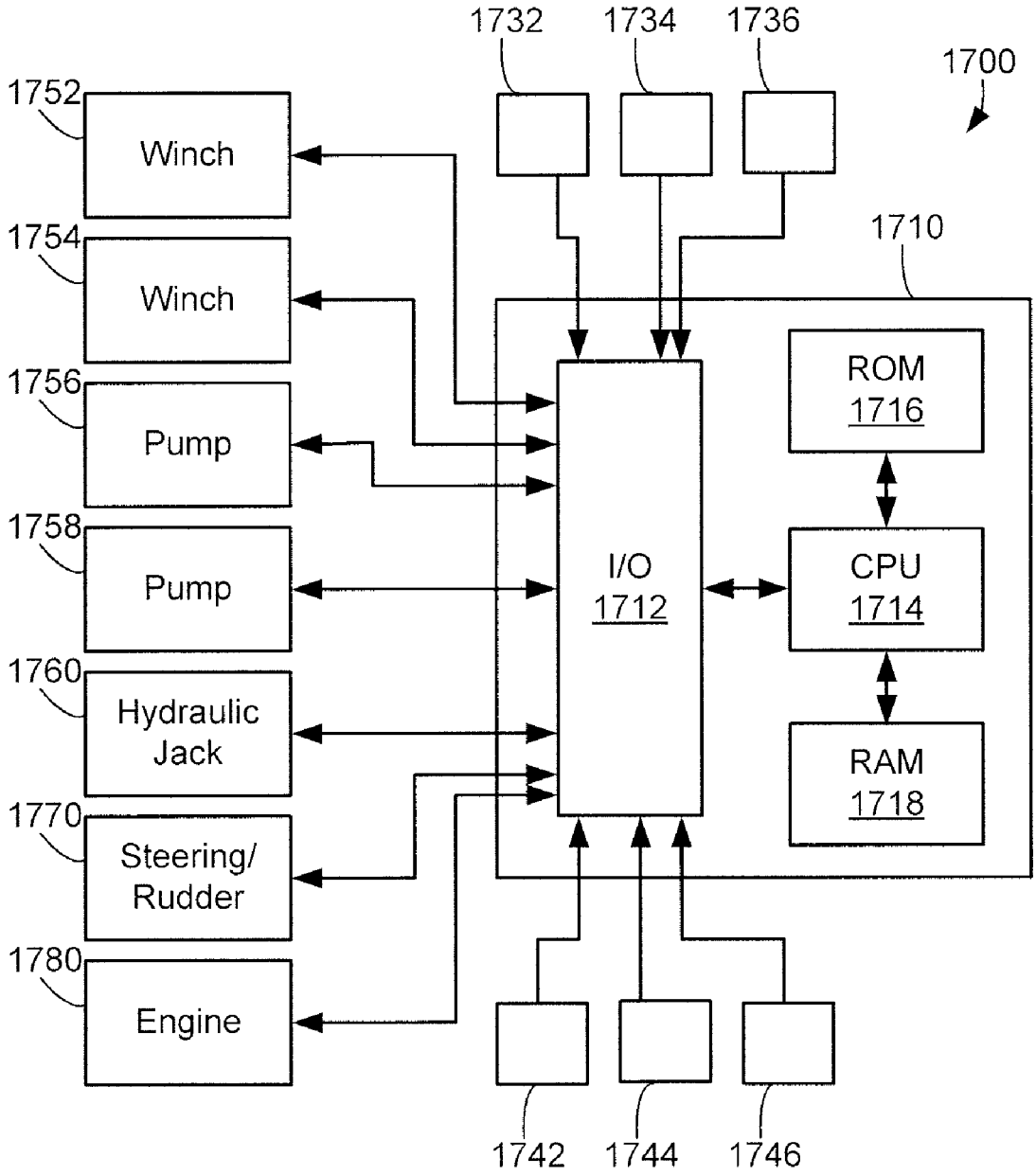
FIG. 17 illustrates an example control system that may be used to facilitate operation of at least some of the systems and methods described herein.

FIG. 17 illustrates an example control system that may be used to control one or more of the various control operations described herein. Note that in some embodiments, only some of the various control operations may be facilitated by a control system, while other control operations may be performed manually by a human operator. In particular, FIG. 17 illustrates a control system 1700 including an electronic control unit (ECU) 1710.

ECU 1710 is shown in FIG. 17 as a microcomputer, including microprocessor unit 1714, input/output ports 1712, an electronic storage medium for executable programs and calibration values shown as read only memory chip 1716 in this particular example, random access memory 1718, communicating via a data bus. ECU 1710 can receive input signals from one or more user operated control devices indicated, for example, at 1732, 1734, and 1736. These control devices may include any suitable device for receiving a user input including, but not limited to switches, levers, buttons, controllers, pedals, steering wheels, etc. Further, ECU 1710 can receive signals from one or more sensors indicated, for example, at 1742, 1744, and 1746. These sensors may include any suitable sensor for detecting or measuring a particular condition of the watercraft or ambient condition. As one example, one or more position sensors may be used for detecting the relative position or angle of the reconfigurable systems described herein, including the position of the keel, the amount of water ballast stored within the keel, the amount of water stored within one or more of the trim tanks, orientation or trim of the watercraft, position of one or more of the mast sections, the orientation, angle or position of a winch or other assistance device, among others. Further, ECU 1710 can receive ambient information from sensors such as an anemometer, watercraft speed indicator, etc. In this way, ECU 1710 can receive input signals from one or more sensors and/or user control devices.

ECU 1710 can be programmed or configured to provide various output signals in response to one or more input signals received from sensors or user control devices. For example, ECU 1710 can control one or more winches indicated at 1752 and 1754, and one or more pumps indicated at 1756 and 1758. Where a hydraulic jack is used to assist with the reconfiguration of the mast assembly between the erected and folded configuration, the ECU can be used to control the position of the hydraulic jack as indicated at 1760. Further, ECU 1710 can control a propulsion system of the watercraft, such as an auxiliary engine, for example, as indicated at 1770 (e.g. such as during non-sailing operations) and/or watercraft control systems such as rudder position indicated at 1780. Note that the winches indicated at 1752 and 1754 can correspond to powered winches that may be used to assist in reconfiguration of the mast assembly and/or positioning of the keel, as described herein. Similarly, pumps 1756 and 1758 can correspond to pumps for supplying or removing water from the keel and/or various trim tanks.

In this way, control system 1700 can be utilized to assist with various control operations of the watercraft including reconfiguration of the mast assembly, deployment of the keel, adjustment of the ballast, and/or trim of the watercraft. While control system 1700 illustrates a single electronic control unit, it should be appreciated that control system 1700 may include two or more independent control units. Further, it should be appreciated that in some embodiments, ECU 1710 may be configured to execute a programmed routine and/or may be at least partially hardwired to perform prescribed tasks.

Figure 18A:
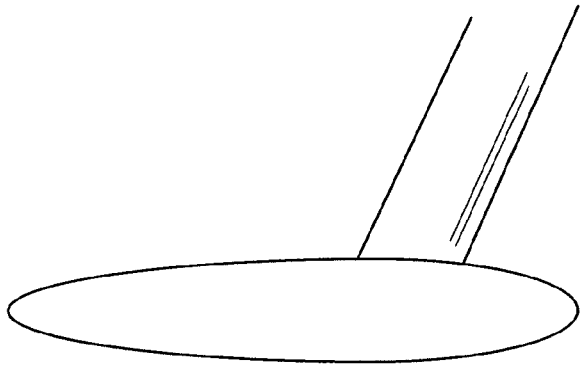
FIG. 18 illustrates example alternative embodiments of a keel arm.
Figure 18B:
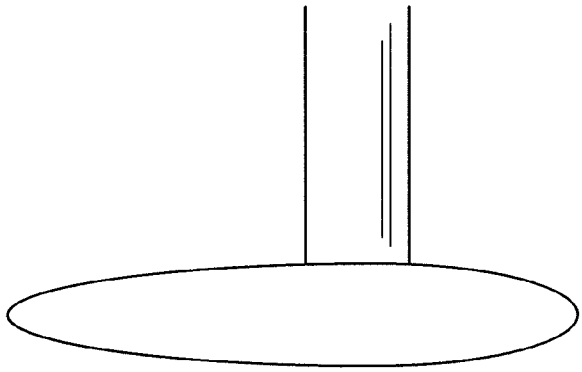
Figure 18C:
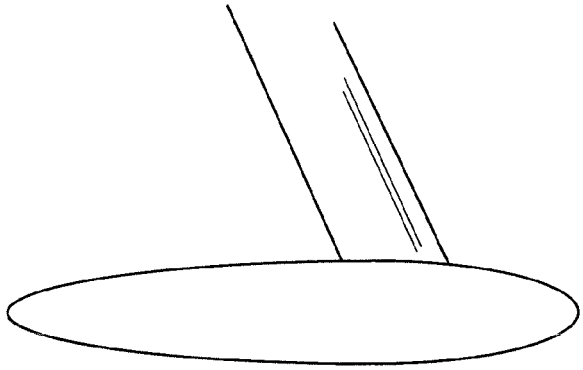
Figure 19A:
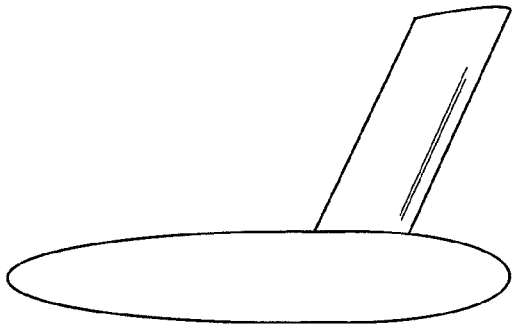
FIG. 19 illustrates example alternative embodiments of a keel bulb for storing water ballast.
Figure 19B:
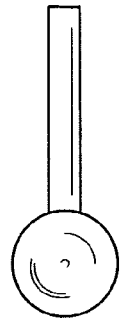
Figure 19C:
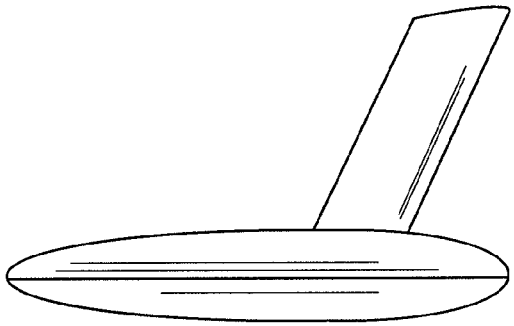
Figure 19D:
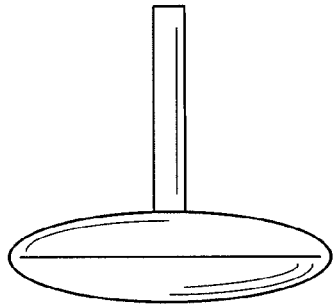
Figure 19E:
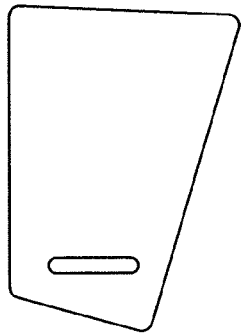
Figure 19F:
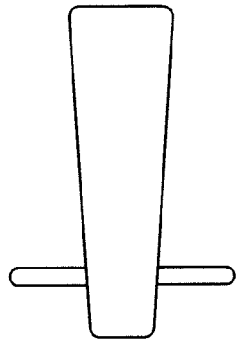
Figure 19G:
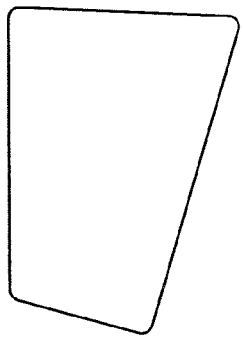
Figure 19H:
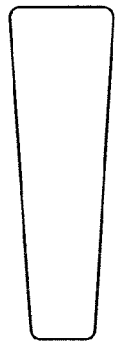

FIGS. 18 and 19 illustrate various alternative embodiments of the keel that may be used with the various systems and methods described herein. In particular, FIG. 18 illustrates alternative embodiments of the keel arm. For example, FIG. 18A illustrates a rearward angled arm, such as was described above with reference to FIGS. 14-16, whereby the position of the keel is translated rearward along the longitudinal axis upon deployment and is translated forward along the longitudinal axis upon retraction. FIG. 18B illustrates a vertical keel arm, such as may be used to achieve deployment in the substantially vertical direction. FIG. 18C illustrates a keel including a forward angled arm. Thus, in this embodiment, the keel may translate forward along the longitudinal axis upon deployment and rearward upon retraction. While the keel system described with reference to FIGS. 14-16 may be deployed or retracted by translation of the keel arm, it should be appreciated that swing arm systems may be utilized in conjunction with the variable ballast system. For example, an upper end of the keel arm can be rotatably coupled to the hull to enable the keel to be rotated outward from the bottom surface of the hull upon deployment. In this manner, various alternative embodiments of the keel system may be utilized in conjunction with the various ballast system.

FIG. 19 illustrates alternative embodiments of the keel. In particular, FIG. 19 illustrates a keel including different bulbs configurations. In each embodiment illustrated in FIG. 19, the keel can be deployed and retracted from the hull and/or can be utilized to store water ballast as described above with reference to FIGS. 14-16. For example, FIGS. 19A and 19B illustrate a side and front view, respectively, of a keel including a cylindrical bulb while FIGS. 19C and 19D illustrate a side and front view, respectively, of a keel including a bulb having a flat-iron configuration. Beyond the bulbs illustrated in FIGS. 19A-19D, it should be appreciated that any suitable bulb configuration can be utilized with the systems and methods described herein. FIGS. 19E and 19F illustrate a front and side view of a keel including wing stabilizers. In this particular embodiment, water ballast may be stored in the wing stabilizers and/or the arm of the keel. Similarly, water ballast may be stored in a keel that does not include a bulb or wing stabilizers, such as illustrated in FIGS. 19G and 19H. In this way, various keel configurations may be utilized with the systems and methods described herein for reconfiguring the keel and/or adjusting the ballast of the watercraft.

Figure 20:
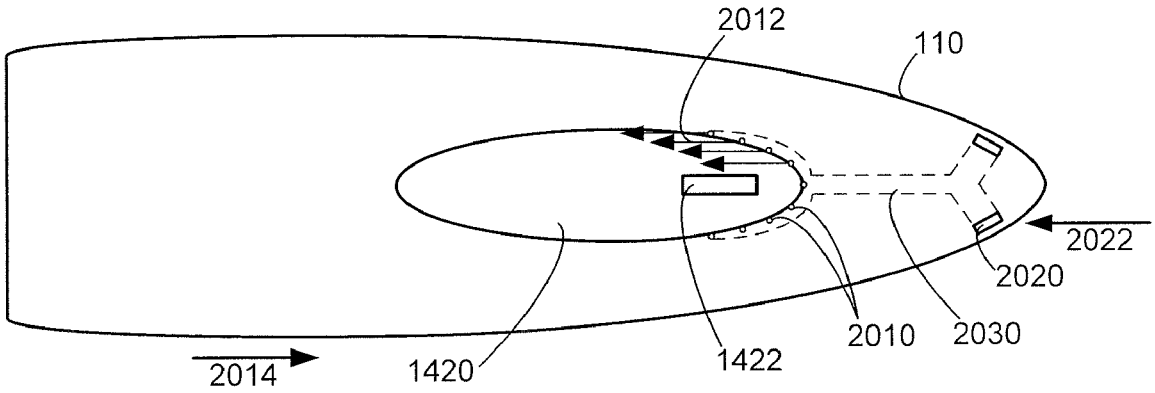
FIGS. 20 and 21 illustrate an example air injection system for reducing drag force on the hull of the watercraft.
Figure 21:
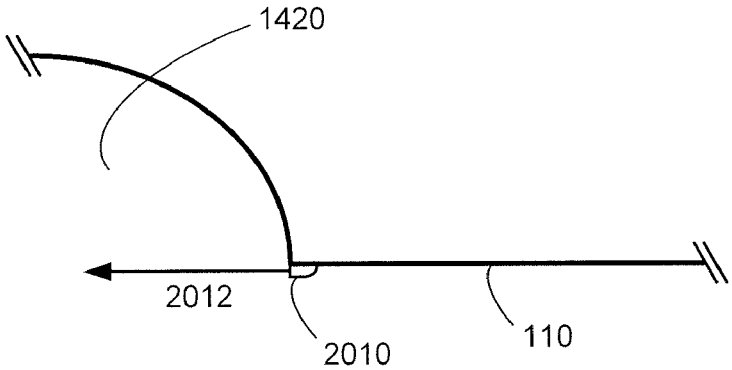

Referring now to FIGS. 20 and 21, a system and method is described for reducing the amount of drag force on the hull of a watercraft by introducing air in the vicinity of a potential source of increased drag. In particular, FIGS. 20 and 21 illustrate an air injection system that may be used with a reconfigurable keel as described above with reference to FIGS. 14-16. However, it should be appreciated the air injection system may be utilized with any suitable watercraft or hull configuration to reduce hull drag. A bottom view of watercraft 100 including hull 110 having a depressed region 1420 for receiving the keel in a retracted configuration is illustrated in FIG. 20. Depressed region 1420 may include a channel 1422 for receiving the keel arm. A detailed side view of the watercraft of FIG. 20 is illustrated in FIG. 21. Hull 110 can include one or more air injection ports 2010 for introducing air into the flow of water surrounding the hull. As one example, the air injection ports may be located near the leading edge of the depressed region. Air injection ports 2010 can be configured to provide an injection of air as indicated generally by vector 2012. The particular direction of the air injection can be configured to reduce the amount of water recirculation caused by depressed region 1420, thereby reducing hull drag.

Air may be introduced by a powered source (e.g. via an air pump or compressor) and/or via a passive system such as may be provided by forward motion of the watercraft. For example, the direction of travel of the boat as indicated at 2014 can cause ambient air to flow into one or more intake ports or scoops 2020 as indicated by vector 2022. In this particular embodiment, intake ports 2020 are located above the water line near the front of the boat. However, it should be appreciated that one or more intake ports may be arranged at any suitable location of the watercraft. Intake air received via ports 2020 can be supplied to injection ports 2010 via air intake passage 2030. Note that vector 2012 is merely a non-limiting example of a possible air injection vector and that other directions of air introduction are possible. For example, air may be injected at any suitable angle to define the hull in the region of the deployed keel, thereby providing different hull configurations and therefore different amounts of drag on the hull. Further, the amount and/or velocity of the injected air may be controlled based on speed of the watercraft and/or turning direction, among other conditions. For example, the volume and/or speed of the air injected along the hull may be increased with increasing speed of the watercraft. Note that the air injection may be increased or decreased without user input, for example, where intake ports 2020 are used or a control system may be used to control the operation of an air pump or compressor. In this way, air can be introduced in the vicinity of a higher drag region, thereby reducing drag on the hull of the watercraft.

Figure 22:
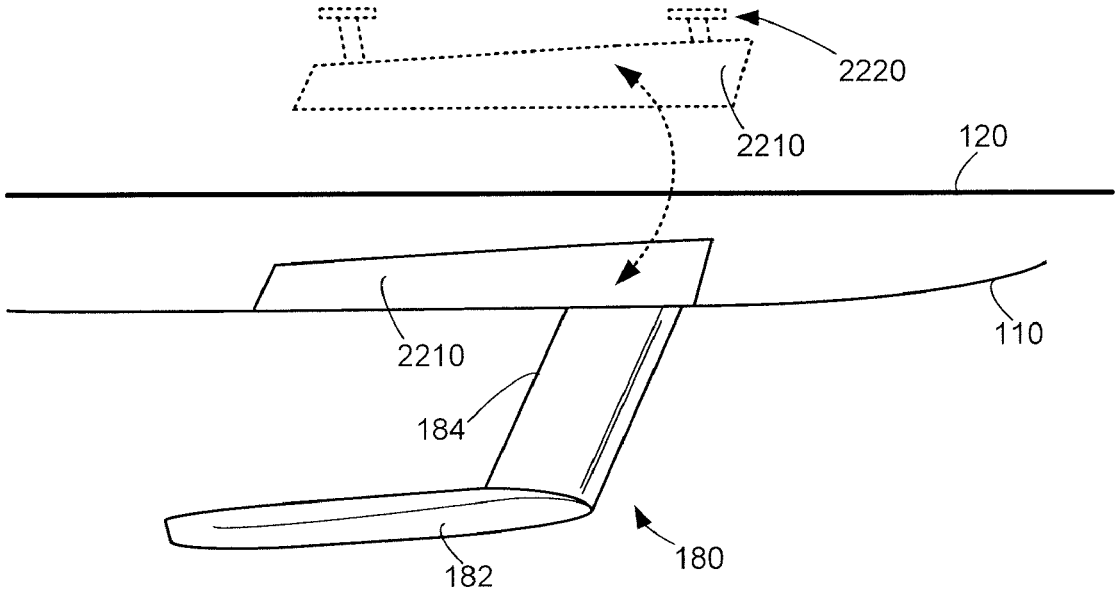
FIGS. 22 and 23 illustrate example doors that may be used to at least partially cover a depressed region of the hull for receiving the retracted keel bulb.
Figure 23:
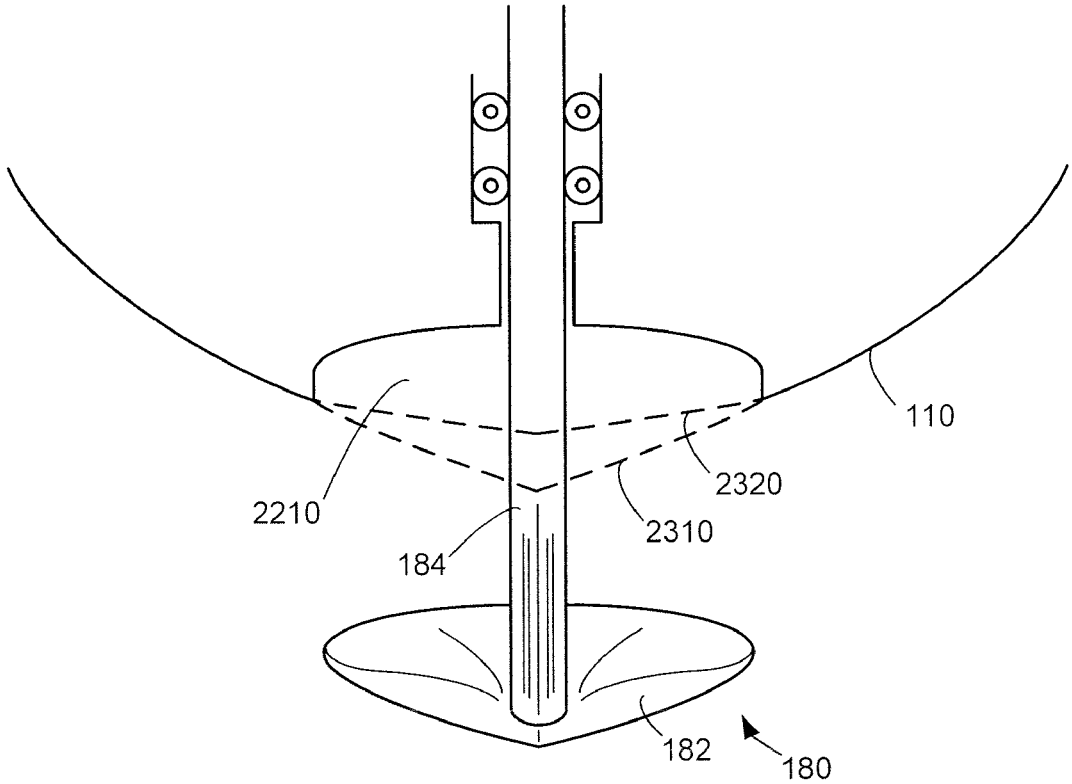

Alternatively or in addition to the air injection system of FIGS. 20 and 21, one or more doors or shields may be utilized to at least partially cover the depressed region for receiving the keel bulb when fully retracted. For example, FIGS. 22 and 23 illustrate how a door indicated at 2210 can be moved from a stored position above water line 120 to cover the depressed region. For example, each side of the watercraft can include one or more doors that seal around keel arm 184 to provide a more hydrodynamic hull. Further, as illustrated in FIG. 23, one or more doors 2210 can be configured to provide different hull configurations, for example, as indicated at 2310 and 2320. For example, the bottom surface of bulb 182 can provide a first hull configuration when fully retracted and one or more doors 2210 can provide a second hull configuration. As one non-limiting example, the bulb of the keel can provide a planing hull configuration when fully retracted while the doors can provide a displacement hull configuration when utilized to cover a portion of the hull opening. In this manner, the hull configuration may be adjusted to provide different hull characteristics.

Doors 2210 can be deployed to cover a depressed region of the hull using any suitable approach. As one example, doors 2210 can be moveably coupled to the hull as indicated at 2220 above the water line so that the doors do not add additional drag to the hull when not in use. As the keel is deployed, the doors can be translated downward to at least partially cover the hull. For example, the doors may be coupled to the hull via a track that enables the doors to translate between the deployed configuration below water line and the stowed configuration above waterline. As yet another example, one or more doors may be stored within the depressed region, where they may be deployed when the keel is deployed. However, it should be appreciated that these are just examples of the various approaches that may be used to reduce drag on the hull by the application of one or more doors.

Note that the example control routines included herein, for example, with reference to FIGS. 13 and 16, can be used with various watercraft configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium of the control system.

It will be appreciated that the various configurations and routines disclosed herein are exemplary in nature, and that these specific embodiments are not to be considered in a limiting sense, because numerous variations are possible. For example, the above technology can be applied to any suitable type or size of watercraft including multiple passenger boats and useral watercraft. The subject matter of the present disclosure includes all novel and nonobvious combinations and subcombinations of the various systems and configurations, and other features, functions, and/or properties disclosed herein.

We claim:

1. A foldable mast assembly for a sailing vessel, comprising:

a lower mast section;

an intermediate mast section having a lower end foldably coupled to an upper end of the lower mast section;

an upper mast section having a lower end foldably coupled to an upper end of the intermediate mast section;

a boom coupled to the lower mast section; and a first locking device configured to:

inhibit folding of the upper mast section relative to the intermediate mast section in a locked position; and permit folding of the upper mast section relative to the intermediate mast section in an unlocked position;

wherein the first locking device includes a first moveable insert internal the upper and intermediate mast sections, whereby the first moveable insert is moveable between the locked and unlocked positions by adjusting an amount of overlap between the moveable insert and at least one of the intermediate and upper mast sections.

2. The foldable mast assembly of claim 1, wherein the boom includes a boom furler for furling and unfurling a sail.

3. The foldable mast assembly of claim 1, further comprising a mast stepping support adapted to receive and rigidly couple a lower end of the lower mast section to a sailing vessel.

4. The foldable mast assembly of claim 1, wherein the upper end of the lower mast section is foldably coupled to the lower end of the intermediate mast section by a first hinge assembly, wherein the first hinge assembly is arranged on a stern side of the mast assembly.

5. The foldable mast assembly of claim 4, wherein the upper end of the intermediate mast section is foldably coupled to the lower end of the upper mast section by a second hinge assembly, wherein the second hinge assembly is arranged on a bow side of the mast assembly.

6. The foldable mast assembly of claim 1, wherein the upper mast section is longer than the intermediate mast section; and wherein the upper mast section is longer than the lower mast section.

7. The foldable mast assembly of claim 1, wherein an upper end of the upper mast section folds from an erected position toward the bow side of the mast assembly and wherein the upper end of the intermediate mast section folds from the erected position toward the stern side of the mast assembly.

8. The foldable mast assembly of claim 1, further comprising a second locking device configured to:

inhibit folding of the intermediate mast section relative to the lower mast section in a locked position; and permit folding of the intermediate mast section relative to the lower mast section in an unlocked position;

wherein the second locking device includes a second moveable insert internal the intermediate and lower mast sections, whereby the second moveable insert is moveable between the locked and unlocked positions by adjusting an amount of overlap between the second moveable insert and at least one of the intermediate and lower mast sections.

9. The foldable mast assembly of claim 8, wherein the first and second moveable inserts each include an elongate element that is tapered along its length.

10. A foldable mast assembly for a sailing vessel, comprising:

an upper mast section including a first track segment at a stern side of the upper mast section, the first track segment being adapted to guide a luff edge of a sail between a raised configuration and a lowered configuration of the sail;

an intermediate mast section including a second track segment at a stem side of the intermediate mast section, the second track segment being adapted to guide the luff edge of the sail between the raised configuration and lowered configuration;

a first hinge assembly foldably coupling a lower end of the upper mast section at a bow side of the upper mast section to an upper end of the intermediate mast section at a bow side of the intermediate mast section;

a lower mast section having a lower end adapted to be received by a stepping support of the sailing vessel; and a second hinge assembly foldably coupling a lower end of the intermediate mast section at the stern side of the intermediate mast section to an upper end of the lower mast section at a stern side of the lower mast section, wherein the second hinge assembly includes:

a first hinge, including a first hinge half coupled to the intermediate mast section and a second hinge half coupled to the lower mast section; and a second hinge, including a third hinge half coupled to the intermediate mast section and a fourth hinge half coupled to the lower mast section;

wherein the second track segment is located alone the length of the stern side of the intermediate mast section and passes between the first and third hinge halves at the lower end of the intermediate mast section;

wherein the lower mast section further includes a third track segment at the stern side of the lower mast section, the third track segment being adapted to guide the luff edge of the sail between the raised configuration and the lowered configuration;

wherein the third track segment and the second track segment are aligned to guide the luff edge of the sail between the second track segment and the third track segment.

11. The foldable mast assembly of claim 10, wherein the first and second track segments are aligned to guide the luff edge of the sail between the first track segment and the second track segment.

12. The foldable mast assembly of claim 10, wherein the second track segment has an upper end that extends to the upper end of the intermediate mast section and a lower end that terminates a distance from the lower end of the intermediate mast section before reaching the second hinge assembly.

13. The foldable mast assembly of claim 12, wherein the first track segment has a lower end that extends to the lower end of the upper mast section and an upper end that terminates near the upper end of the upper mast section.

14. The foldable mast assembly of claim 10, further comprising a boom coupled to the lower mast section between.

* * * * *